US012365508B2

(12) United States Patent
Bressan et al.

(10) Patent No.: US 12,365,508 B2
(45) Date of Patent: Jul. 22, 2025

(54) CHILD-PROOF CONTAINER, PROCESS FOR MAKING THE SAME AND METHOD FOR OPENING SAID CONTAINER

(71) Applicant: I.G.B. S.R.L., Milan (IT)

(72) Inventors: Michel Bressan, Induno Olona (IT); Alessio Bressan, Varese (IT); Alberto Gandolla, Induno Olona (IT)

(73) Assignee: I.G.B. S.R.L., Milan (IT)

( * ) Notice: Subject to any disclaimer, the term of this patent is extended or adjusted under 35 U.S.C. 154(b) by 80 days.

(21) Appl. No.: 18/020,573

(22) PCT Filed: Aug. 2, 2021

(86) PCT No.: PCT/IB2021/057047

§ 371 (c)(1),
(2) Date: Feb. 9, 2023

(87) PCT Pub. No.: WO2022/043794

PCT Pub. Date: Mar. 3, 2022

(65) Prior Publication Data

US 2023/0303289 A1 Sep. 28, 2023

(30) Foreign Application Priority Data

Aug. 25, 2020 (IT) ..... 102020000020419
Feb. 1, 2021 (IT) ..... 102021000002054

(51) Int. Cl.
*B65D 5/66* (2006.01)
*B65D 5/02* (2006.01)

(52) U.S. Cl.
CPC ..... *B65D 5/6608* (2013.01); *B65D 5/0254* (2013.01); *B65D 2215/02* (2013.01); *B65D 2215/04* (2013.01)

(58) Field of Classification Search
CPC ..... B65D 5/0254; B65D 5/66; B65D 5/6608; B65D 5/6632; B65D 5/665; B65D 2215/02; B65D 2215/04
(Continued)

(56) References Cited

U.S. PATENT DOCUMENTS 4,964,561 A * 10/1990 Whelan ..... B65D 5/6667 229/149
5,803,345 A * 9/1998 Jones ..... B65D 5/6608 229/148
(Continued)

FOREIGN PATENT DOCUMENTS

EP 3 461 757 4/2019
JP 2014-141276 8/2014
(Continued)

OTHER PUBLICATIONS

International Search Report and Written Opinion cited in PCT/IB2021/057047, mailed Sep. 21, 2021, 19 pages.

*Primary Examiner* — Bryon P Gehman
(74) *Attorney, Agent, or Firm* — Nixon & Vanderhye P.C.

(57) ABSTRACT

A child-proof container including a storage, for housing a product, and a closure system configured for defining a closed condition and an open condition of the container. The container includes a first coupling portion carried by the closure system and a second coupling portion carried by the storage and configured for cooperating with the first coupling portion to define a locking condition in which the first and second coupling portions prevent the closure system from passing from the closed condition to the open condition.

18 Claims, 14 Drawing Sheets

(58) Field of Classification Search
USPC ..... 206/1.5
See application file for complete search history.

(56) References Cited

U.S. PATENT DOCUMENTS

| | | | | |
|---|---|---|---|---|
| 10,364,062 | B2 * | 7/2019 | Bressan | B65D 5/0254 |
| 10,370,140 | B2 * | 8/2019 | Bressan | B65D 5/0254 |
| 10,494,136 | B2 * | 12/2019 | Bressan | B65D 5/6608 |
| 11,220,382 | B2 * | 1/2022 | Bressan | B65D 5/6608 |
| 2019/0009944 | A1 * | 1/2019 | Bressan | B65D 5/0254 |

FOREIGN PATENT DOCUMENTS

| | | |
|---|---|---|
| WO | 2016/198978 | 12/2016 |
| WO | 2017/216662 | 12/2017 |

* cited by examiner

FIG.9
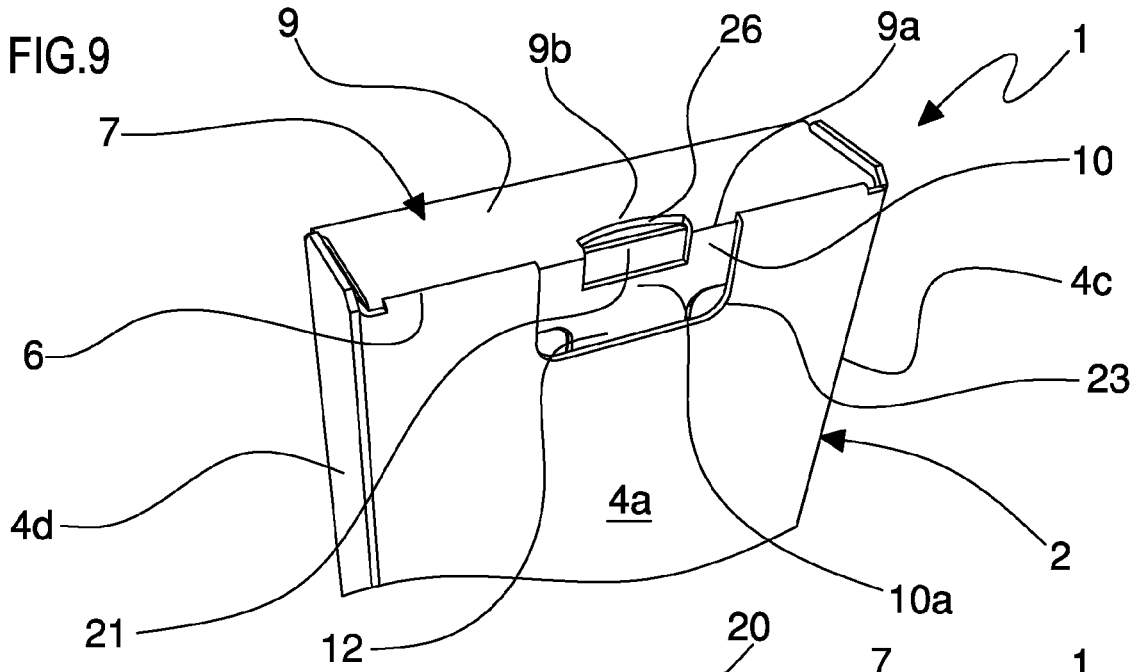
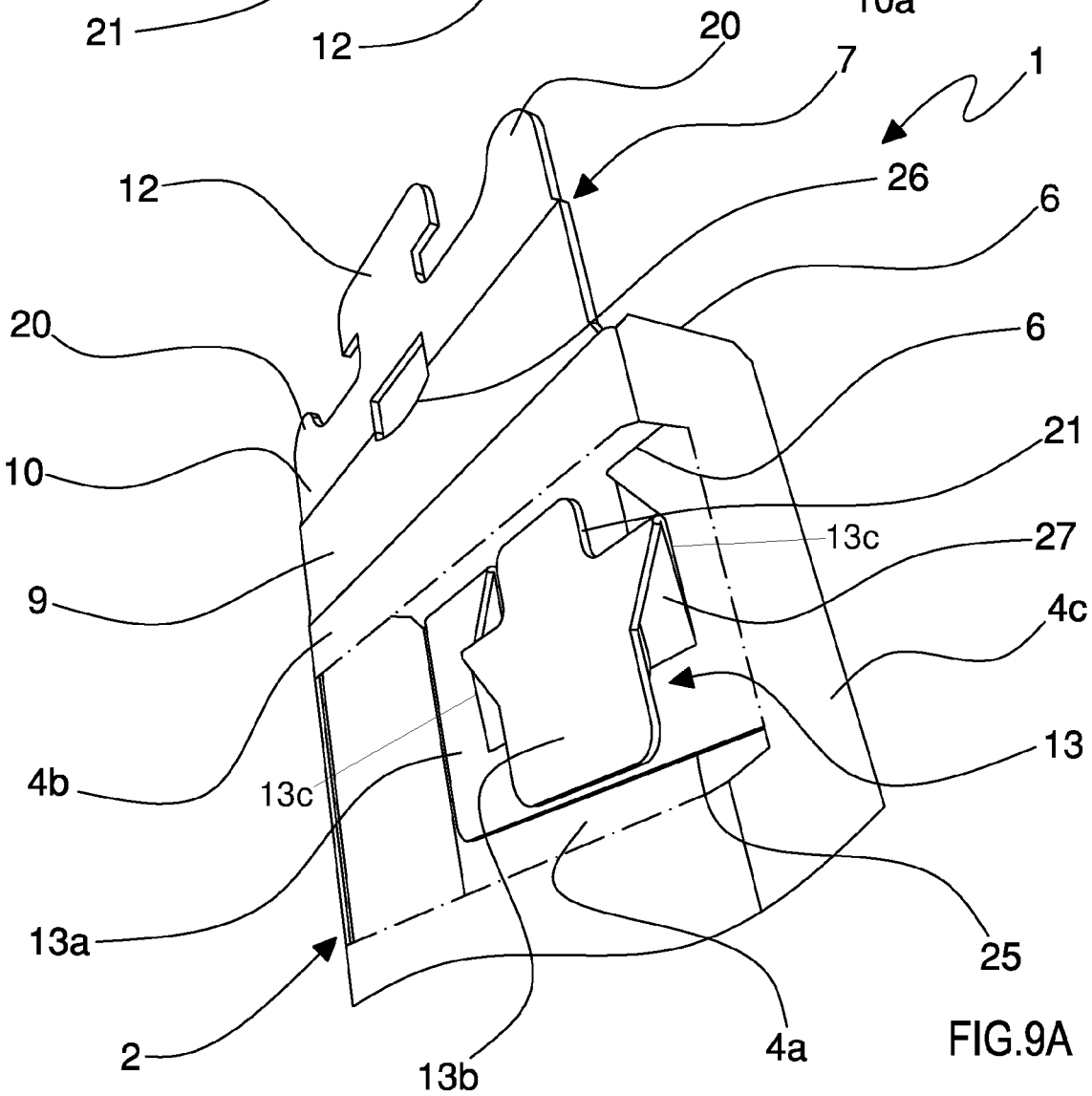
FIG.9A

FIG.9B
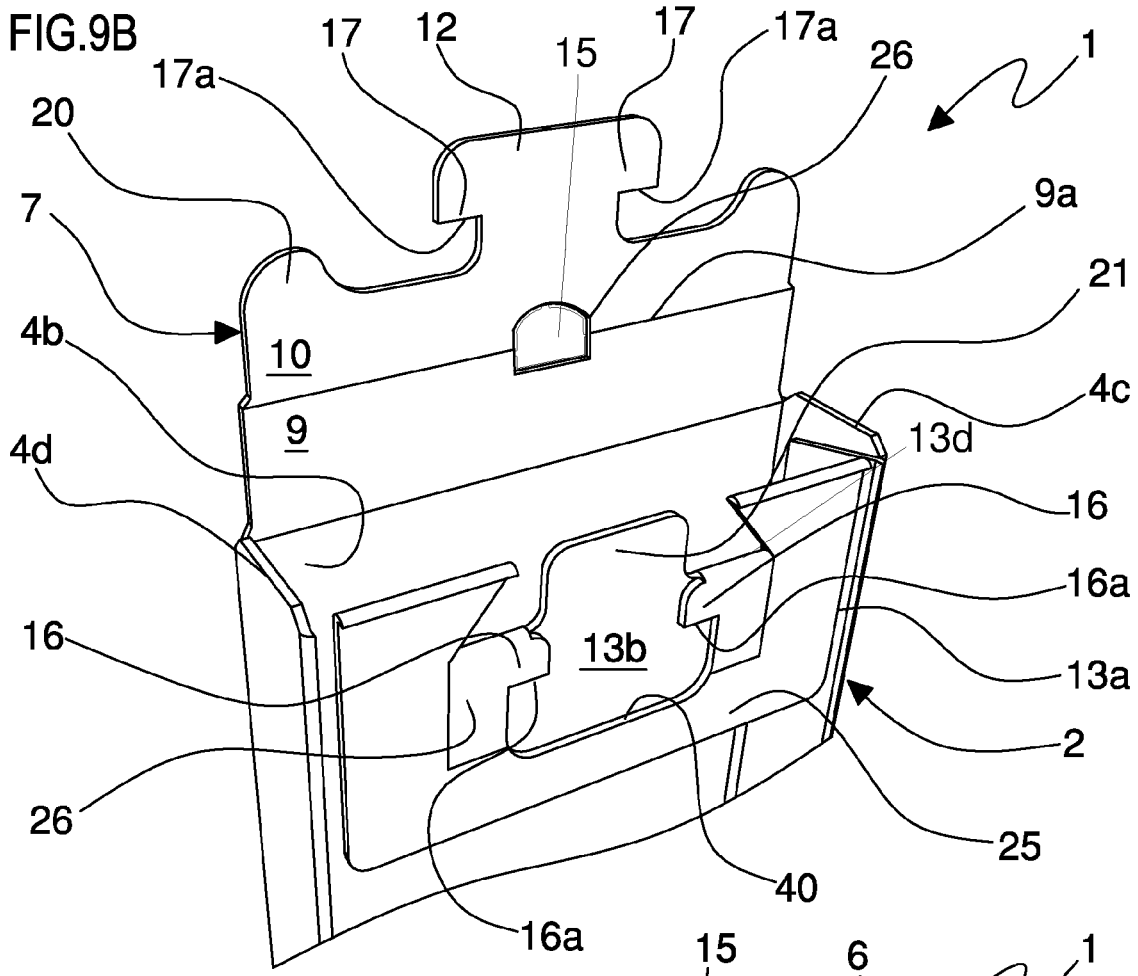
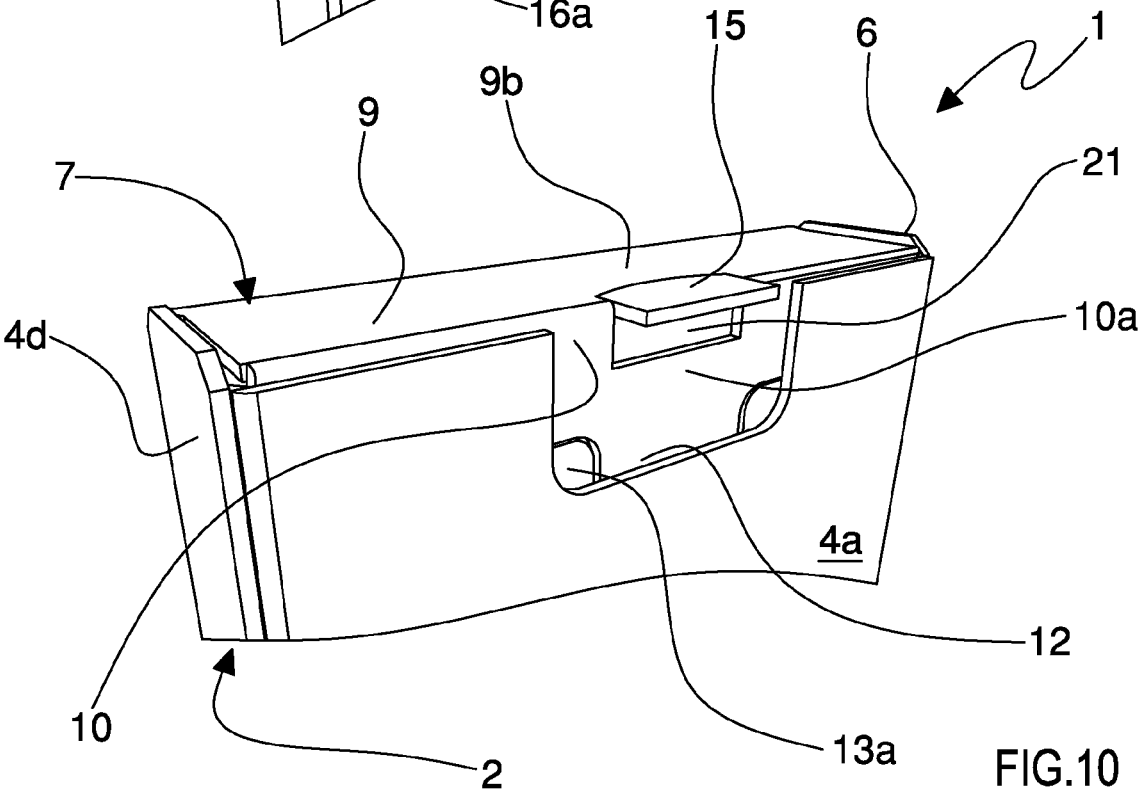
FIG.10

FIG.13
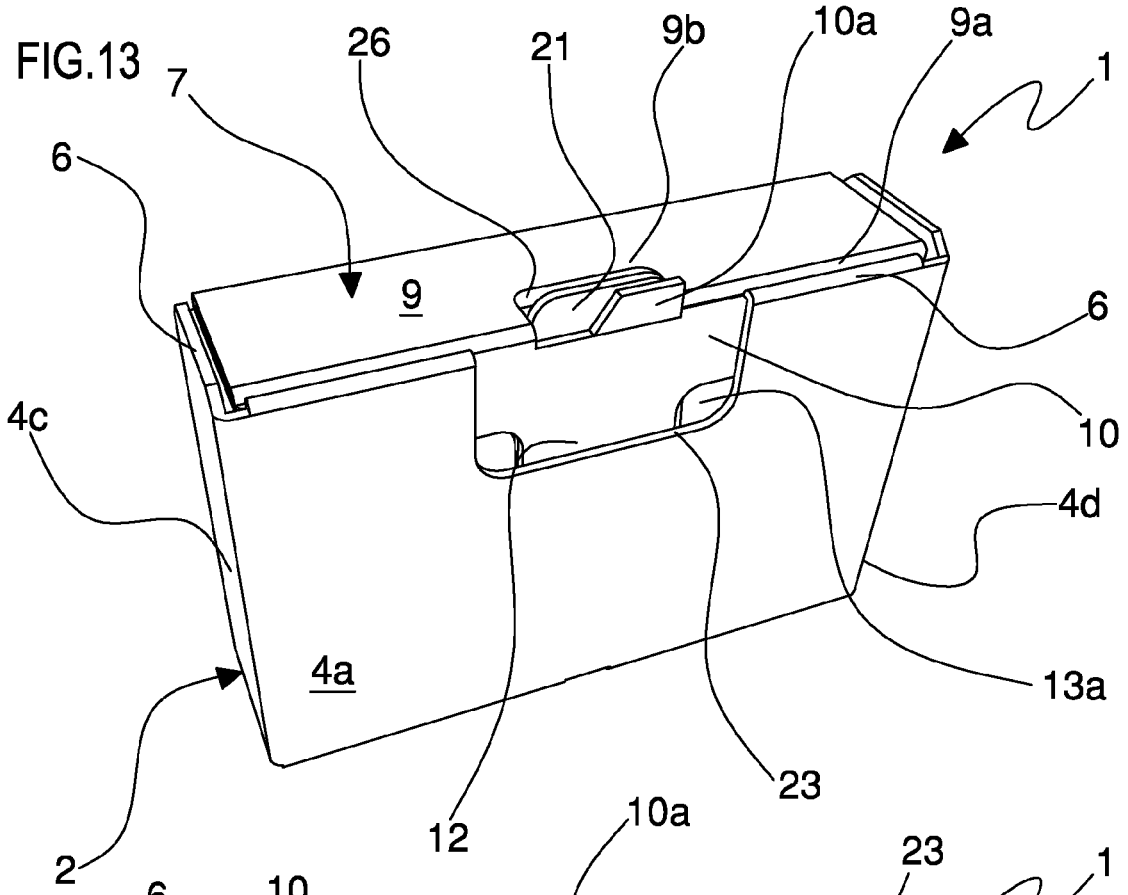
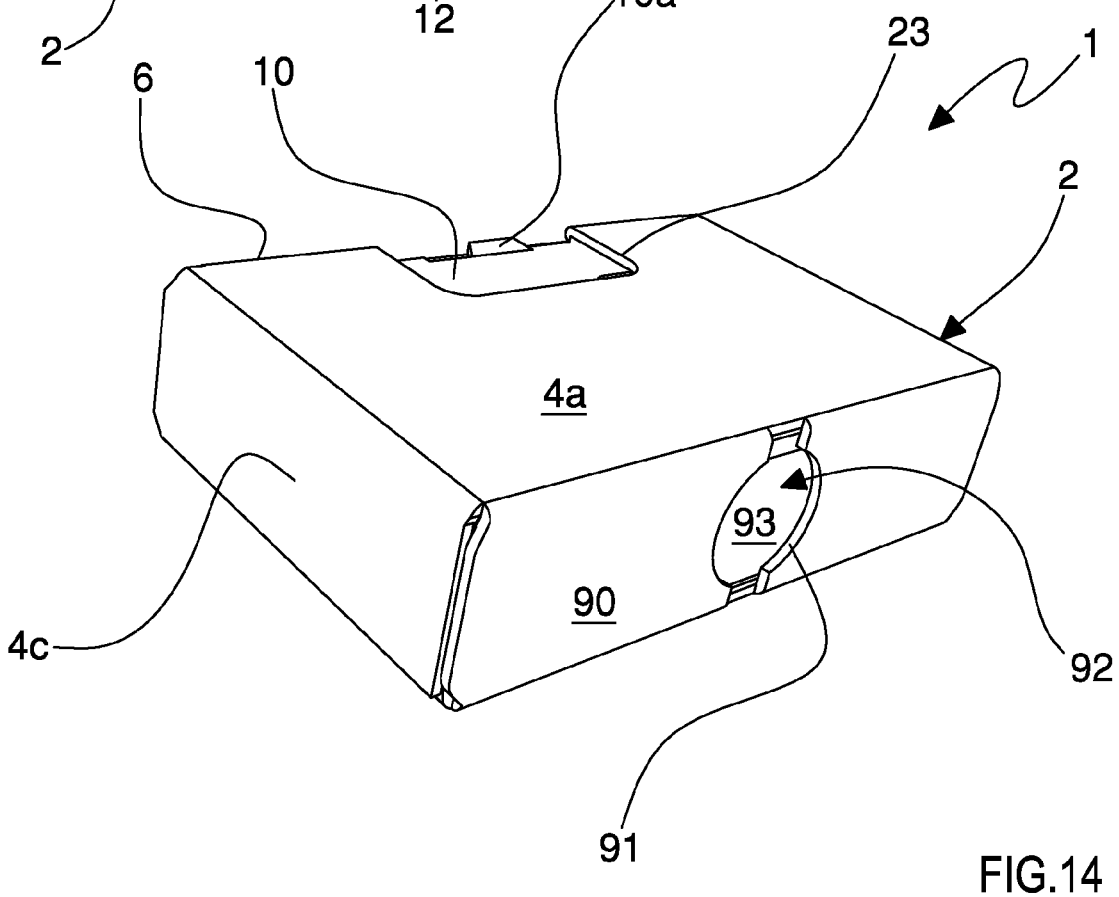
FIG.14

FIG.16
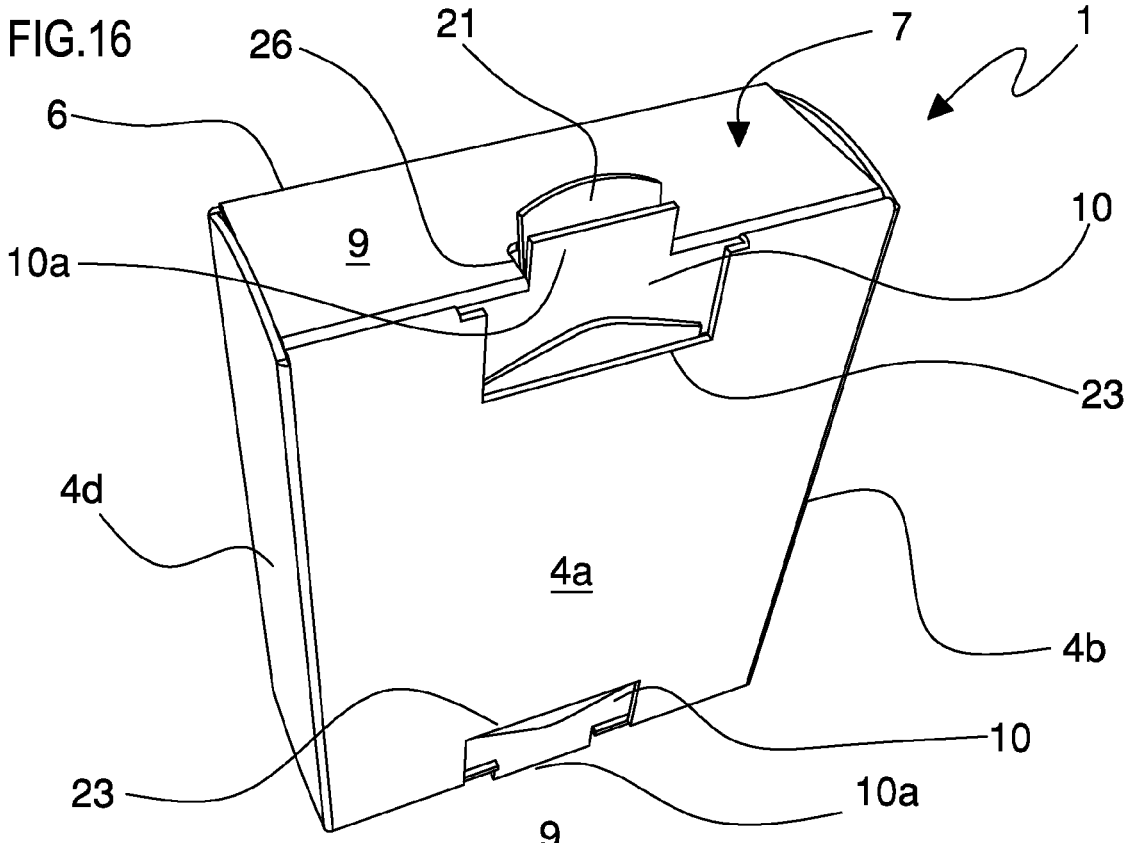
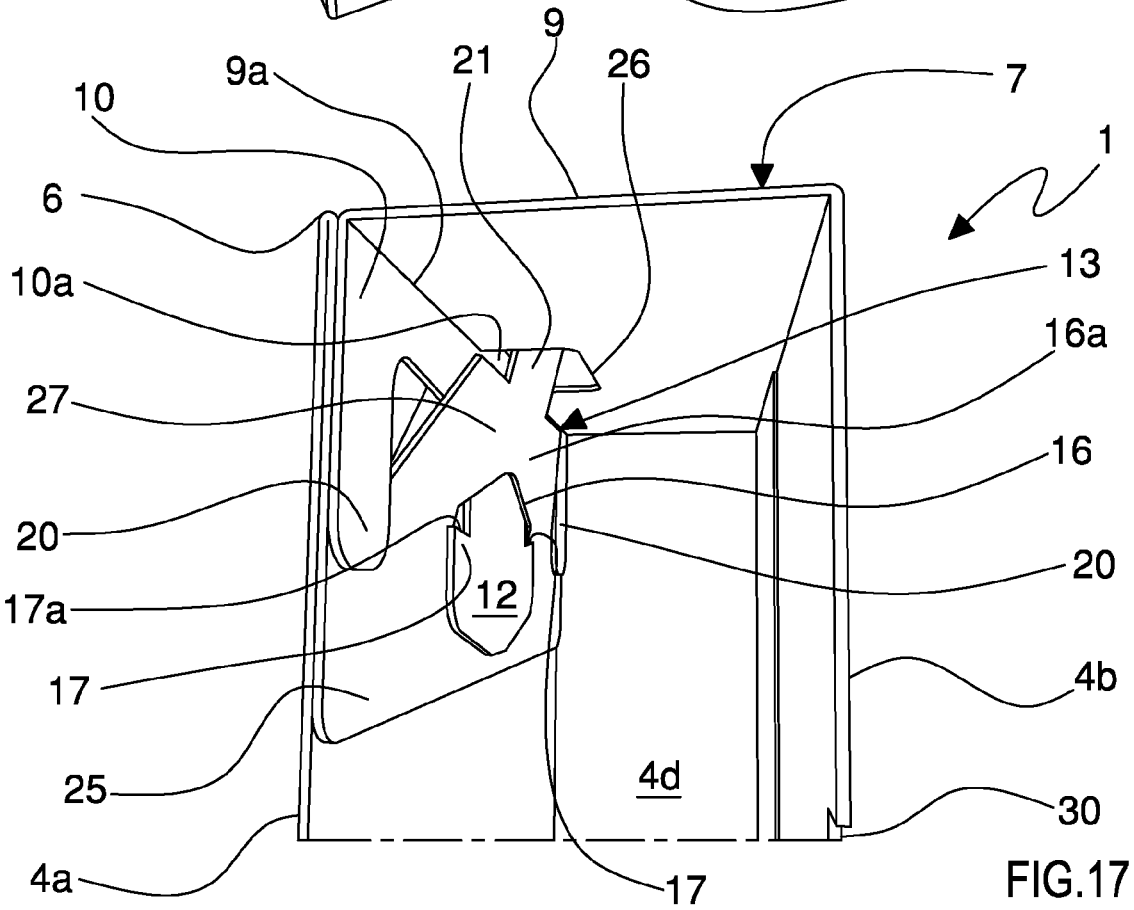
FIG.17

FIG.20
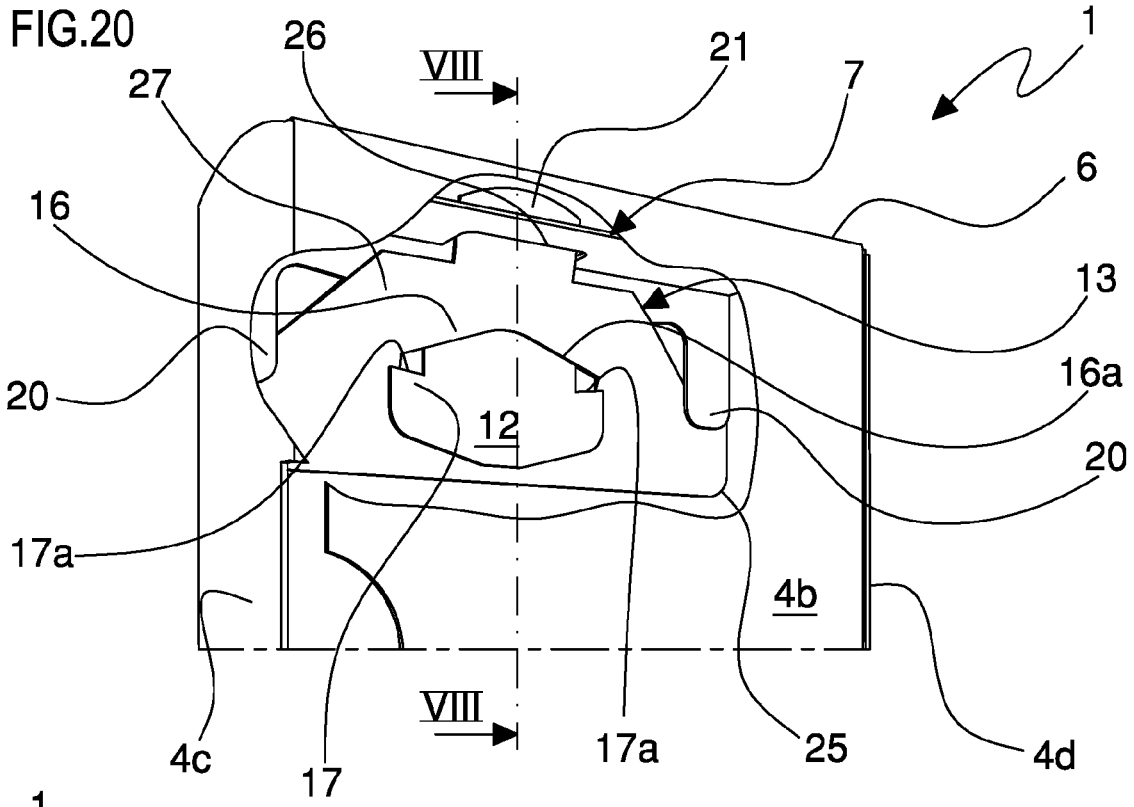
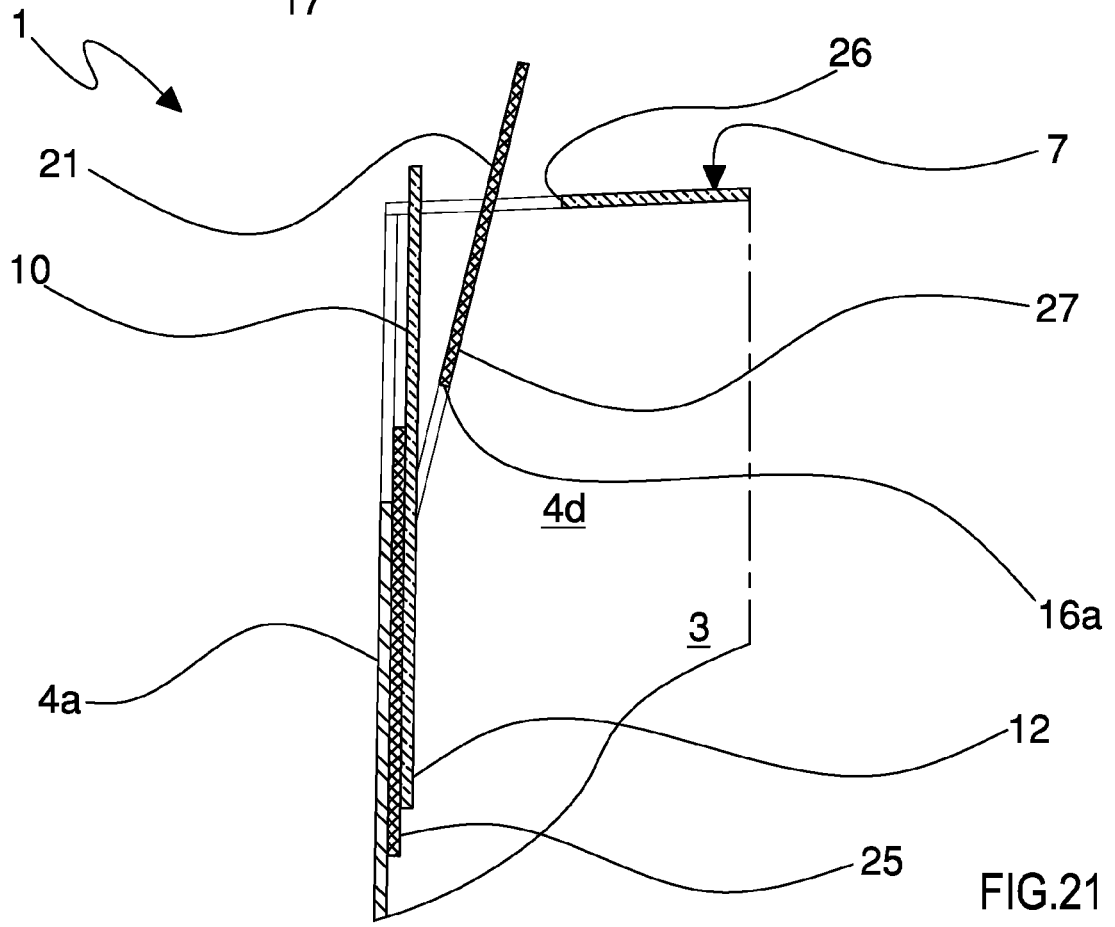
FIG.21

CHILD-PROOF CONTAINER, PROCESS FOR MAKING THE SAME AND METHOD FOR OPENING SAID CONTAINER

CROSS-RELATED APPLICATION

This application is the U.S. national phase of International Application PCT/IB2021/057047, filed Aug. 2, 2021, which designated the U.S. and claims priority to Italian patent applications IT 102021000002054, filed Feb. 1, 2021, and IT 102020000020419, filed Aug. 25, 2020, the entire contents of each of these applications are incorporated by reference.

FIELD OF THE FINDING

The object of the present invention is a child-proof container, a process for making said container, as well as a method for opening the same. The container can have application in the fields which provide for packaging products and where it is required, for safety reasons, to prevent children from opening the container. For example, the container can be employed in the pharmaceutical, cosmetic and food fields.

STATE OF THE ART

As is known, containers are available on the market that are designed for being broken upon a first opening. One type of such containers is described in the patent application No. JP 2014141276 A and comprises a storage that can be reclosed following the irreversible engagement between a first coupling portion carried by a closure system and a second coupling portion carried by the storage. The second coupling portion comprises a hook carried by a sheet engaged with a front wall of the storage: the opening of the container occurs following the breakage of a weakening portion defined on a rear wall of the storage, which allows tearing the closure system from the storage. Even if widely used, such containers, defined with inviolable opening, have considerable limitations. Indeed, such containers only obstruct a first opening of the container; however, once open for the first time, the container cannot be reused since it cannot be reclosed and correctly contain the products. The Applicant also detects that such containers are not very safe since they are incapable of defining a correct child-proof system.

Also available on the market are child-proof containers designed for preventing children from coming into contact with products that are potentially dangerous for them. One type of child-proof container is described in the patent application PCT No. WO 2016/198978 A1; such container comprises a storage that is openable/recloseable by means of a closure system associated with the storage. The closure system carries an inserting portion adapted to cooperate, in the closed condition of the container, with a respective inserting portion placed within the storage. The closure system has a slit adapted to allow the insertion of an opening device configured for disengaging the inserting portions of the storage and of the closure system for opening the container. Even if the container described in the patent application WO 2016/198978 A1 defines, with respect to the above-described containers with inviolable opening, an efficient child-proof system, the Applicant has detected that such solution can be improved with regard to several aspects.

OBJECT OF THE FINDING

Object of the present invention is therefore that of substantially resolving at least one of the drawbacks and/or limitations of the preceding solutions.

A first objective of the present invention is to provide a container which can effectively prevent a child from opening the same and which simultaneously has a solid structure capable of ensuring its own integrity after multiple openings and closings of the same. Another object of the invention is to provide a child-proof container that can be openable in a quick manner by an adult.

Another object of the present invention is to provide a child-proof container having a simple and compact structure, attainable in a quick and inexpensive manner. In particular, an object of the present invention is to attain a container which does not require modifying the common plants used today for making containers of standard type and which also do not require modifying the existing packaging plants for filling the container itself. A further object is to provide a container having a structure which allows facilitating the closure thereof in a machine, reducing to a minimum the possibility of an incorrect first closure (reinforcement) of the container. Another object of the present invention is that of providing a container which is effective in closing but which simultaneously can be flexible in use, i.e. which can be easily opened by an adult manually and/or by means of different (optionally common) opening devices These and still other objects, which will be clearer from the following description, are substantially achieved by a container, a process for making said container and a method for opening the latter in accordance with one or more of the enclosed claims and/or of the following aspects.

SUMMARY

In one aspect, a child-proof container is provided comprising:

- a storage (2) defining an internal volume (3) configured for housing at least one product, the storage (2) having a predetermined number of lateral walls defining at least one passage opening (5) delimited by a free edge (6), said passage opening (5) being configured for placing the internal volume (3) in communication with the external environment,
- at least one closure system (7) movable with respect to the storage (2) at least between:
  - a closed condition in which the closure system (7) itself prevents the communication between the internal volume (3) of the storage (2) and the external environment, and
  - an open condition in which the closure system (7) itself allows the communication between the internal volume (3) and the external environment,
- at least one first coupling portion (12) carried by the closure system (7),
- at least one second coupling portion (13) carried by the storage (2) and arranged at least partly in the internal volume (3),
- in which the first and the second coupling portions (12, 13), in the closed condition, are configured for being stably engaged with each other to define a locking condition of the container in which said first and second coupling portions (12, 13) prevent the closure system (7) from passing from the closed condition to the open condition.

In one aspect according to the preceding aspect the second coupling portion (13) is at least partly housed in the internal volume (3). In one aspect according to any one of the preceding aspects the second coupling portion (13) is directly engaged with the storage (2). In one aspect according to any one of the preceding aspects the second coupling portion (13) is directly engaged with a lateral wall of the storage, optionally with a lateral front wall (4*a*) of the storage (2). In one aspect according to any one of the preceding aspects the second coupling portion (13) defines at least one undercut (16) configured for stably engaging the first coupling portion (12), in the closed condition of the container to define said locking condition. In one aspect according to any one of the preceding aspects the second coupling portion (13) is at least partly movable with respect to the storage (2) at least between:

a locking position in which the second coupling portion (13) allows the stable engagement between the undercut (16) and the first coupling portion (12), optionally preventing the disengagement thereof, and a releasing position in which the second coupling portion (13) allows the first coupling portion (12) to be disengaged from the undercut (16) to allow the passage of the closure system from the closed condition to the open condition. In one aspect according to any one of the preceding aspects the closure system (7) comprises at least one through access (26), in which the container (1) also comprises a thrust portion (21) carried by the second coupling portion (13) and placed at the through access (26), said thrust portion (21) being configured for allowing the movement of at least part of said second coupling portion (13) itself from the locking position to the releasing position.

In one aspect according to the preceding aspect the through access (26) is configured for allowing a user, in the locking condition and from outside the container, to manually intervene and/or by means of an opening device (19) on the thrust portion (21) to allow the movement of at least part of the second coupling portion (13) from the locking position to the releasing position. In one aspect according to any one of the preceding aspects the thrust portion (21), at least in the locking condition, at least partly traverses said through access (26), optionally at least partly exiting from the container. In one aspect according to any one of the preceding aspects the through access (26) has a passage section greater than a size of the thrust portion (21).

In one aspect according to any one of the preceding aspects the thrust portion (21), in the releasing position of the second coupling portion (13), has a minimal distance from the free edge (6) of the storage (2) greater than a minimal distance present between said thrust portion (21) and said free edge (6) when said second coupling portion (13) is in the locking position. In one aspect according to any one of the preceding aspects at least part of the thrust portion (21), in the locking condition, directly faces and is placed in proximity to the through access (26). In one aspect according to any one of the preceding aspects at least part of the thrust portion (21), in the locking condition, traverses the through access (26) and projects from the closure system (7) for a predetermined height. In one aspect according to any one of the preceding aspects at least part of the thrust portion (21), in the locking condition, traverses the through access (26) and projects from the free edge (6) of the storage (2) for a predetermined height. In one aspect according to any one of the preceding aspects the ratio between the height of the thrust portion (21) emerging from the free edge (6) of the storage (2) and the extension of the thrust portion (21) itself is greater than 0.1, optionally comprised between 0.2 and 0.9, still more optionally comprised between 0.3 and 0.8. In one aspect according to any one of the preceding aspects the height of the thrust portion (21) emerging from the free edge (6) is greater than 2 mm, optionally comprised between 3 mm and 10 mm.

In one aspect according to any one of the preceding aspects the through access (26), in the closed condition, is placed at the free edge (6) of the storage (2).

In one aspect according to any one of the preceding aspects excluding the nine preceding aspects the thrust portion (21), in the locking condition, is entirely housed in the internal volume of the storage (2). In one aspect according to any one of the preceding aspects the thrust portion (21), in the locking condition, faces the through access (26). In one aspect according to any one of the preceding aspects the second coupling portion (13) comprises:

at least one first panel (13*a*) engaged with the storage (2), said first panel (13*a*) comprising a through opening configured for defining said undercut (16), at least one second panel (13*b*) engaged with the first panel (13*a*).

In one aspect according to the preceding aspect the second panel (13*b*) is arranged at the through opening of the first panel (13*a*) to define, in cooperation with said through opening of the first panel (13*a*), a seat (40) configured for housing, during the closed condition of the closure system (7), the first coupling portion (12) to allow the stable engagement between the first and the second coupling portions (12, 13). In one aspect according to any one of the preceding aspects the second panel (13*b*) is superimposed on the first panel (13*a*). In one aspect according to any one of the preceding aspects the second panel closes the through opening (13*a*) of the first panel (13*a*) in a manner such that the seat (40) of the second coupling portion (13) is blind.

In one aspect according to any one of the preceding aspects the first panel (13*a*) of the second coupling portion (13) is at least partly arranged in the internal volume (3) of the storage (2). In one aspect according to any one of the preceding aspects the first panel (13*a*) of the second coupling portion (13) is entirely arranged in the storage (2), optionally it is entirely contained in the internal volume (3) of the storage (2). In one aspect according to any one of the preceding aspects the first and the second panels (13*a*, 13*b*) are engaged with each other to define a folded portion. In one aspect according to any one of the preceding aspects the folded portion defined by said first and second panels (13*a*, 13*b*) is substantially parallel to a lateral wall (optionally a lateral front wall 4*a*) of the storage (2) directly carrying said second coupling portion (13). In one aspect according to any one of the preceding aspects the second panel (13*b*) is directly engaged with and superimposed on the first panel (13*a*). In one aspect according to any one of the preceding aspects the second panel is only engaged with the first panel (13*a*).

In one aspect according to any one of the preceding aspects at least part of the first panel (13*a*) and at least part of the second panel (13*b*) are movable with respect to the storage (2). In one aspect according to any one of the preceding aspects at least part of the first panel (13*a*) and at least part of the second panel (13*b*) are movable with respect to the storage (2) to define:

the locking position of the second coupling portion (13) in which said first and second panels (13*a*, 13*b*) are approached to a lateral wall of the storage with which the first panel (13*a*) is engaged and configured for allowing, optionally in cooperation with said lateral wall, the locking of the first coupling portion (12) within the seat (40), the releasing position of the second coupling portion (13) in which said first and second panels (13*a*, 13*b*) are at least partly distanced from the lateral wall of the storage with which the first panel (13*a*) is engaged to allow the disengagement, optionally the extraction, of the first coupling portion (12) from the seat (40).

In one aspect according to any one of the preceding aspects the undercut (16) defined by the through opening of the first panel (13*a*) defines at least one hook (16*a*) configured for stably engaging, at least in the locking condition, the first coupling portion (12). In one aspect according to any one of the aspects the hook (16*a*) of the second coupling portion (13) is configured for stably engaging, at least in the locking condition, at least one respective hook (17*a*) defined by the first coupling portion (12). In one aspect according to any one of the preceding aspects the undercut (16) defined by the through opening of the first panel (13*a*) defines two hooks (16*a*) configured for stably engaging, at least in the locking condition, the first coupling portion (12). In one aspect according to any one of the preceding aspects the two hooks (16*a*) of the second coupling portion are configured for engaging two respective hooks (17*a*) of the first coupling portion. In one aspect according to any one of the preceding aspects the two hooks (16*a*) of the second coupling portion have respective concavities facing each other. In one aspect according to any one of the preceding aspects the through opening of the first panel (13*a*) is distanced from the free edge (6) of the storage (2). In one aspect according to any one of the preceding aspects the at least one hook (16*a*) of the second coupling portion (13) is completely arranged in the internal volume of the storage (2). In one aspect according to any one of the preceding aspects the at least one hook (16*a*) of the second coupling portion (13) is distanced from the free edge (6) of the storage (2).

In one aspect according to any one of the preceding aspects the second panel (13*b*) is integrally joined to the first panel (13*a*) and folded with respect to the latter at a fold edge arranged substantially in interposition between the seat (40) and the thrust portion (21) In one aspect according to the preceding aspect the fold edge present between first and second panels (13*a*, 13*b*) essentially defines a further undercut adapted to block the first coupling portion (12). In one aspect according to the two preceding aspects the fold edge present between first and second panels (13*a*, 13*b*) is configured for stably locking the first coupling portion (12)—optionally the at least one hook (17*a*) of the first coupling portion (12)—between said first and second panels (13*a*, 13*b*). In one aspect according to the preceding three aspects the fold edge of the first and second panels (13*a*, 13*b*) is defined outside the seat (40). In one aspect according to the preceding three aspects the fold edge of the first and second panels (13*a*, 13*b*) is defined on the side opposite the base portion (25) constrained to the storage (2).

In one aspect according to any one of the preceding aspects the through access (26) is configured for allowing a user, from outside the container, to contact (optionally manually) said thrust portion (21) to move said first and second panels (13*a*, 13*b*) from the locking position to the releasing position. In one aspect according to any one of the preceding aspects the through access (26) is configured to allow, in the locking condition, at least the insertion of an opening device (19) in interposition between the second panel (13*b*) and the first coupling portion (12) to allow the disengagement between said first coupling portion (12) and said second coupling portion (13). In one aspect according to any one of the preceding aspects the through access (26) is configured to allow, in the locking condition, at least the insertion of an opening device (19) at least partly within the seat (40) to allow the extraction of the first coupling portion (12) from the seat (40) in a manner such to allow the consequent disengagement between said first coupling portion (12) and said second coupling portion (13). In one aspect according to any one of the preceding aspects the thrust portion (21) is defined on the second panel (13*b*). In one aspect according to any one of the preceding aspects the thrust portion (21) is integrally joined to the second panel (13*b*) of the second coupling portion (13). In one aspect according to any one of the preceding aspects the thrust portion (21) emerges from the second panel (13*b*). In one aspect according to any one of the preceding aspects the second panel (13*b*) of the second coupling portion (13) lies on an extension plane, in which the thrust portion (21) les on a respective extension plane substantially parallel to, optionally coinciding with, the extension plane of the second panel (13*b*) of the second coupling portion (13). In one aspect according to any one of the preceding aspects the second panel (13*b*) of the second coupling portion (13) and 35 the thrust portion (21) are defined by a single tongue made of sheet material, optionally paper. In one aspect according to any one of the preceding aspects the thrust portion (21) is integrally movable with the second panel (13*b*) of the second coupling portion (13) at least between the locking position and the releasing position, and vice versa. In one aspect according to any one of the preceding aspects the thrust portion (21) emerges from the second panel (13*b*), in the locking condition of the container, in the direction of the closure system (7). In one aspect according to any one of the preceding aspects the thrust portion (21) at least partly faces through access (26).

In one aspect according to any one of the preceding aspects the through access (26) is configured for allowing a user, from outside the container, to manually contact said thrust portion (21) to move said first and second panels (13*a*, 13*b*) from the locking position to the releasing position.

In one aspect according to any one of the preceding aspects the thrust portion (21), at least in the locking condition, is configured for guiding the insertion of the opening device (19) in interposition between the second panel (13*b*) and the lateral wall of the storage (2) directly carrying said first panel (13*a*). In one aspect according to any one of the preceding aspects the thrust portion (21), at least in the locking condition, is configured for guiding the insertion of at least part of the opening device (19) within the seat (40) to allow the disengagement between the first and the second coupling portions (12, 13).

In one aspect according to any one of the preceding aspects the through access (26) is configured for allowing a user, from outside the container, for gripping the closure system (7) and thus allowing, following the disengagement between the first and the second coupling portions (12, 13), the extraction of the first coupling portion (12) from the seat (40). In one aspect according to any one of the preceding aspects the first and second coupling portions (12, 13) can be disengaged following the extraction of the first coupling portion (12) from the seat (40).

In one aspect according to any one of the preceding aspects the first panel (13*a*) comprises:

at least one base (25) directly fixed, for example by means of gluing, to the storage, optionally to a front wall (4*a*) of the storage (2), at least one main body (27) carried by the base (25) and on which said at least the undercut (16) of the second coupling portion is defined.

In one aspect according to any one of the preceding aspects the second panel (13*b*) is directly constrained only to the main body (27) of the first panel (13*a*). In one aspect according to any one of the preceding aspects the main body (27) is not directly constrained to the lateral wall of the storage with which the first panel (13*a*) is directly engaged. In one aspect according to any one of the preceding aspects in which only the main body (27) of the first panel (13*a*), together with the second panel (13*b*), are movable at least between the locking position and the releasing position, and vice versa. In one aspect according to any one of the preceding aspects the entire second panel (13*b*) is movable at least between the locking position and the releasing position, and vice versa. In one aspect according to any one of the preceding aspects the base (25) is not movable with respect to the storage (2). In one aspect according to any one of the preceding aspects the hook (16*a*) of the second coupling portion (16) is defined entirely on the main body (27). In one aspect according to any one of the preceding aspects the second coupling portion (13) comprises at least one hook (16*a*) delimiting said undercut (16) which is configured for stably engaging said first coupling portion (12). In one aspect according to any one of the preceding aspects the thrust portion (21) directly emerges from the hook (16*a*). In one aspect according to any one of the preceding aspects the hook (16*a*) of the second coupling portion (13) has a grip edge delimiting said undercut (16), in which said thrust portion (21) directly emerges from the hook (16*a*) of the second coupling portion (13) on the side opposite said grip edge. In one aspect according to any one of the preceding aspects the hook (16*a*) of the second coupling portion (13) lies on an extension plane, in which the thrust portion (21) lies on a respective extension plane substantially parallel to, optionally coinciding with, the extension plane of the hook (16*a*) of the second coupling portion (13). In one aspect according to any one of the preceding aspects the thrust portion (21) and the hook (16*a*) of the second coupling portion (13) are joined in a single piece. In one aspect according to any one of the preceding aspects the hook (16*a*) of the second coupling portion (13) and the thrust portion (21) are defined by a single tongue made of sheet material, optionally paper. In one aspect according to any one of the preceding aspects the thrust portion (21) is integrally movable with the hook (16*a*) of the second coupling portion (13) at least between the locking position and the releasing position, and vice versa.

In one aspect according to any one of the preceding aspects the hook (16*a*) of the second coupling portion (13) comprises a tongue having a substantially "C" or "U" shape. In one aspect according to the preceding aspect the concavity of the tongue defining the hook (16*a*) of the second coupling portion (13) is directed according to a direction entering the storage (2).

In one aspect according to any one of the preceding aspects the second coupling portion (13) comprises at least one base (25) fixed, for example by means of gluing, to the storage (2). In one aspect according to the preceding aspect the base (25) is directly fixed to the storage (2). In one aspect according to any one of the preceding aspects the hook (16*a*) of the second coupling portion (13) is directly carried by the base (25). In one aspect according to any one of the preceding aspects the hook (16*a*) of the second coupling portion (13) is only constrained directly to the base (25). In one aspect according to any one of the preceding aspects the base (25) is integral with the hook (16*a*) of the second coupling portion (13). In one aspect according to any one of the preceding aspects the hook (16*a*) of the second coupling portion (13) is hinged to the base (25). In one aspect according to any one of the preceding aspects the hook (16*a*) of the second coupling portion (13) is substantially interposed between the base (25) and the thrust portion (21). In one aspect according to any one of the preceding aspects the base (25) of the second coupling portion (13) is engaged in proximity to the free edge (6) of the storage (2). In one aspect according to any one of the preceding aspects the base (25) is joined to a section of the free edge (6) of the storage (2)

In one aspect according to any one of the preceding aspects the hook (16*a*) of the second coupling portion (13), when arranged in the locking position, has an angular offset with respect to the base (25) that is different from an angular offset with respect to the same base (25) when said hook (16*a*) is in the releasing position.

In one aspect according to any one of the preceding aspects the hook (16*a*) of the second coupling portion (13) and the base (25) delimit, in cooperation with each other, a through opening configured for insertingly receiving at least one part of the first coupling portion (12) to allow the engagement thereof with the second coupling portion (13). In one aspect according to any one of the preceding aspects the through opening is on the upper part delimited by the grip edge of the hook (16*a*) of the second coupling portion (13).

In one aspect according to any one of the preceding aspects the undercut (16) is placed entirely within the storage (2), separate and distanced from the free edge (6). In one aspect according to any one of the preceding aspects the hook (16*a*) of the second coupling portion (13) is entirely housed in the internal volume (3) of the storage (2). In one aspect according to any one of the preceding aspects the grip edge delimited by the hook (16*a*) of the second coupling portion (13) has a substantially "V" shape.

In one aspect according to any one of the preceding aspects the second coupling portion (13) comprises only one hook (16*a*) hinged to the base (25). In one aspect according to any one of the preceding aspects the hook (16*a*) of the second coupling portion (13) is only constrained directly to the base (25).

In one aspect according to any one of the preceding aspects the second coupling portion (13) lacks weakening portions configured to allow the facilitated breakage of the same second coupling portion (13). In one aspect according to any one of the preceding aspects the hook (16*a*) of the second coupling portion (13) lacks weakening portions. In one aspect according to any one of the preceding aspects, between hook (16*a*) of the second coupling portion (13) and the base (25), weakening portions configured to allow the separation of said hook (16*a*) from the base (25) are not present. In one aspect according to any one of the preceding aspects the hook (16*a*) of the second coupling portion (13) is not separable from the base (25) (optionally it is not easily separable from the base if not by means of a forced breakage of the main body).

In one aspect according to any one of the preceding aspects the second coupling portion (13) is made of sheet material, optionally paper. In one aspect according to any one of the preceding aspects the second coupling portion (13) comprises a single folded sheet, optionally made of paper material. In one aspect according to the preceding aspect the single folded sheet defining said second coupling portion (13) is directly constrained to the free edge (6) of the storage (2).

In one aspect according to any one of the preceding aspects the closure system (7) is made of sheet material, optionally paper. In one aspect according to any one of the preceding aspects the closure system (7) is integrally joined to the storage (2). In one aspect according to any one of the preceding aspects the closure system (7) comprises a closure portion (9) configured for at least partly obstructing, in the closed condition, the at least one passage opening (5) of the storage (2). In one aspect according to the preceding aspect the closure portion (9) is at least partly counter-shaped with respect to the free edge of said at least one passage opening (5). In one aspect according to any one of the preceding aspects the closure system (7) is engaged with the free edge (6) of the storage (2) and movable, optionally via rotation, with respect to the latter. In one aspect according to any one of the preceding aspects the closure portion (9) is hinged to the free edge (6) of the storage (2). In one aspect according to any one of the preceding aspects the closure system (7) has at least one inserting portion (10) engaged with the closure portion (9) at a fold edge (9*a*), optionally opposite the free edge (6) of the storage (2), said inserting portion (10) being configured for being inserted at least partly (optionally entirely), in the closed condition, in the internal volume (3) of the storage (2). In one aspect in accordance with any one of the preceding aspects the through access (26) is at least partly delimited by a perimeter edge defined on the closure portion (9) and/or on the inserting portion (10) of the closure system (7). In one aspect according to the preceding aspect the through access (26) is defined entirely on the closure portion (9), optionally only on the closure portion (9). In one aspect according to the preceding aspect the through access (26) is defined entirely on the inserting portion (10), optionally only on the inserting portion (10). In one aspect according to the preceding aspect the through access (26) is defined on the closure portion (9) and on the inserting portion (10) In one aspect according to any one of the preceding aspects the through access (26) is configured to allow the thrust portion (21), in the locking condition, to project outside the container (1) to allow a user to manually intervene and/or by means of an opening device (19) on said thrust portion (21) and thus move at least part of the second coupling portion (13) from the locking position to the releasing position. In one aspect according to any one of the preceding aspects the through access (26) is extended starting from the fold edge (9*a*) towards a central zone of the same closure portion (9) to define a depth of said through access (26). In one aspect according to any one of the preceding aspects the through access (26) has a predetermined width measured along a direction parallel to the fold edge (9*a*) of the closure system (7). In one aspect according to any one of the preceding aspects the ratio between the width of the through access (26) and a width of the closure portion (9), measured along the width of the through access, is comprised between 0.15 and 0.5, optionally comprised between 0.2 and 0.45. In one aspect according to any one of the preceding aspects the ratio between the depth of the through access (26) and a depth of the closure portion (9), measured along the depth of the through access (26), is comprised between 0.15 and 0.4. In one aspect according to any one of the preceding aspects the through access (26) has a substantially square or rectangular shape or substantially "T" shape. In one aspect according to any one of the preceding aspects the ratio between a width of the thrust portion (21) and the width of the through access (26) is comprised between 0.7 and 1, optionally comprised between 0.8 and 0.98; said widths being measured along a direction parallel to the fold edge (9*a*) of the closure system (7). In one aspect according to any one of the preceding aspects the thrust portion (21) is extended in thickness between a first and a second surface that are opposite each other, the ratio between the thickness of the thrust portion (21) and the depth of the through access (26) comprised between 0.02 and 0.15, optionally comprised between 0.03 and 0.1 (optionally said thickness of the thrust portion is measured along the depth of the through access).

In one aspect according to any one of the preceding aspects the inserting portion (10) has at least one grip portion (10*a*) configured for allowing a user, at least in the locking condition of the container, gripping the closure system (7) to allow the extraction of the first coupling portion (12) from the second coupling portion (13). In one aspect according to the preceding aspect the grip portion (10*a*) delimits at least part of the through access (26). In one aspect according to any one of the preceding aspects the grip portion (10*a*), at least during the locking condition, at least partly faces thrust portion (21) of the second coupling portion (13). In one aspect according to any one of the preceding aspects the grip portion (10*a*) is integral with the inserting portion (10).

In one aspect according to any one of the preceding aspects the inserting portion (10) and the grip portion (10*a*) lie on a single extension plane. In one aspect according to any one of the preceding aspects the inserting portion (10) and/or the grip portion (10*a*) do not have weakening portions, optionally configured to allow the facilitated breakage of at least one of said inserting portion (10) and grip portion (10*a*). In one aspect according to any one of the preceding aspects the through access (26) is configured for allowing a user, from outside the container, to grasp the grip portion (10*a*) and to extract the first coupling portion (12) from the storage (2). In one aspect according to any one of the preceding aspects the grip portion (10*a*) delimits at least partly the through access (26).

In one aspect according to any one of the preceding aspects the closure portion (9) of the closure system (7) defines a grip portion (9*b*) arranged at the through access (26) and configured for allowing a user, following the disengagement of the first and second coupling portions (12, 13), to move said closure system from the closed condition to the open condition. In one aspect according to the preceding aspect the grip portion (9*b*) of the closure portion (9) delimits at least part of said through access (26).

In one aspect according to any one of the preceding aspects the storage (2) is made of sheet material, optionally paper. In one aspect according to any one of the preceding aspects the storage (2) comprises at least one front wall (4*a*) and an opposite rear wall (4*b*), in which the second coupling portion (13) is directly carried by the front wall (4*a*) of the storage (2). In one aspect according to any one of the preceding aspects the storage (2) comprises a first and a second lateral wall (4*c*, 4*d*) that are opposite each other, the first and the second lateral wall (4*c*, 4*d*) connecting the front wall and the rear wall (4*a*, 4*b*). In one aspect according to any one of the preceding aspects the storage (2) has a shape substantially as a rectangular parallelepiped. In one aspect according to any one of the preceding aspects the predetermined number of lateral walls defines a first and a second passage opening (5) that are opposite each other and configured for placing the internal volume (3) in communication with the external environment, each of said first and second passage openings being delimited by a respective free edge (6). In one aspect according to any one of the preceding aspects the container comprises a closure system (7) for each passage opening (5) of the storage. In one aspect according to any one of the preceding aspects the closure system (7) is hinged to the free edge section (6) defined by said rear wall (4*b*). In one aspect according to any one of the preceding aspects the closure portion (9) is integrally joined to the rear wall (4*b*) of the storage (2). In one aspect according to any one of the preceding aspects the inserting portion (10) emerges from the closure portion (9) on the side opposite the rear wall (4*b*) of the storage starting from a fold edge (9*a*), optionally opposite the free edge (6) of the storage (2).

In one aspect according to any one of the preceding aspects the second coupling portion (13) is directly engaged with the front wall (4*a*) of the storage (2). In one aspect according to any one of the preceding aspects the first and the second panels (13*a*, 13*b*) of the second coupling portion (13) are substantially parallel to the front wall (4*a*) of the storage. In one aspect according to any one of the preceding aspects the first panel (13*a*) of the second coupling portion (13) is directly engaged with a lateral wall (4) of the storage. In one aspect according to any one of the preceding aspects the first panel (13*a*) is integrally joined to at least one wall of the storage (optionally integrally joined to the front wall 4*a* of the storage). In one aspect according to any one of the preceding aspects the first panel (13*a*) is folded with respect to the lateral wall of the storage (optionally with respect to the front wall 4*a*) to which said first panel (13*a*) is integrally joined, within the storage. In one aspect according to any one of the preceding aspects the first panel (13*a*) is directly integrally joined to the free edge (6) of the storage.

In one aspect according to any one of the preceding aspects the base (25) is directly fixed, optionally by means of gluing, to the front wall (4*a*) of the storage (2). In one aspect according to any one of the preceding aspects the main body (27) of the second coupling portion (13) is interposed between the second panel (13*b*) and the front wall (4*a*) of the storage (2).

In one aspect according to any one of the preceding aspects the hook (16*a*) of the second coupling portion (13), in the locking condition, at least partly directly faces the inserting portion (10). In one aspect according to any one of the preceding aspects the hook (16*a*) is separate and distanced from the free edge (6) of the storage (2). In one aspect according to any one of the preceding aspects the first coupling portion (12), in the locking condition, directly faces (optionally adjacent to) the front wall (4*a*) of the storage (2).

In one aspect according to any one of the preceding aspects the first coupling portion (12) is integrally joined to the closure system (7). In one aspect according to any one of the preceding aspects the first coupling portion (12) is directly carried by the inserting portion (10) of the closure system (7). In one aspect according to any one of the preceding aspects the first coupling portion (12) emerges from the inserting portion (10) on the side opposite the closure portion (9). In one aspect according to any one of the preceding aspects the first coupling portion (12) is in a single piece with the inserting portion (10).

In one aspect according to any one of the preceding aspects the first coupling portion (12), in the locking condition, is stably engaged with the undercut (16) of the second coupling portion (13), optionally at least partly in the internal volume (3) of the storage (2). In one aspect according to any one of the preceding aspects the first coupling portion (12), in the locking condition, is stably engaged with the hook (16*a*) of the second coupling portion (13). In one aspect according to any one of the preceding aspects the first coupling portion (12) comprises at least one respective undercut (17) configured for being stably engaged, in the locking condition, with the undercut (16) of the second coupling portion (13). In one aspect according to any one of the preceding aspects the undercut (17) of the first coupling portion (12) comprises at least one hook (17*a*) configured for being constrained to the undercut (16) of the second coupling portion (13).

In one aspect according to any one of the preceding aspects the hook (17*a*) of the first coupling portion (12), in the locking condition, is arranged completely in the internal volume of the storage. In one aspect according to any one of the preceding aspects the hook (17*a*) of the first coupling portion, in the locking condition, is distanced from the free edge (6) of the storage. In one aspect according to any one of the preceding aspects the at least one hook (17*a*) of the same first coupling portion (12) comprises a first and a second hook opposite each other with respect to a central portion of the first coupling portion (12) itself. In one aspect according to any one of the preceding aspects the first coupling portion (12) has a substantially arrow shape or substantially "T" shape or substantially "V" shape.

In one aspect according to any one of the preceding aspects the undercut (17) of the first coupling portion (12) is configured for being abutted, in the locking condition, against the undercut (16) of the second coupling portion defined by the through opening of the first panel (13*a*). In one aspect according to any one of the preceding aspects the hook (17*a*) of the first coupling portion (12) is configured for being constrained to the hook (16*a*) defined by the undercut of the first panel (13*a*). In one aspect according to any one of the preceding aspects the undercut (17) of the first coupling portion (12), in the locking condition, is arranged completely in the internal volume of the storage. In one aspect according to any one of the preceding aspects the at least one hook (17*a*) of the first coupling portion (12), in the locking condition, is arranged completely in the internal volume of the storage. In one aspect according to any one of the preceding aspects the at least one hook (17*a*) of the first coupling portion (17), in the locking condition, is distanced from the free edge (6) of the storage. In one aspect according to any one of the preceding aspects the hook (17*a*) of the first coupling portion (12) defines a respective seat whose concavity, in the locking condition, directly faces at least one part of the undercut of the second coupling portion (13). In one aspect according to any one of the preceding aspects the at least one hook (17*a*) of the first coupling portion (12), in the locking condition, is configured for being arranged at least partly in the seat (40) of the second coupling portion (13). In one aspect according to any one of the preceding aspects the first coupling portion (12) comprises substantially a tongue made of sheet material, optionally paper, emerging from the closure system (7).

In one aspect according to any one of the preceding aspects the first coupling portion (12) comprises a tongue made of sheet material, optionally paper, emerging from the closure system. In one aspect according to any one of the preceding aspects the inserting portion (10) comprises at least one peripheral tab (20) extended starting from a perimeter portion of said inserting portion. In one aspect according to any one of the preceding aspects the peripheral tab (20) is configured for guiding the first coupling portion (12) in insertion within the storage (2). In one aspect according to any one of the preceding aspects the inserting portion (10) comprises two peripheral tabs (20) that are opposite each other with respect to the first coupling portion (12). In one aspect according to any one of the preceding aspects, each peripheral tab (20) has a substantially square or rectangular shape.

In one aspect according to any one of the preceding aspects the container comprises at least one opening device (19) insertable, at least in the locking condition, through the through access (26) in interposition between the first and the second coupling portions (12, 13). In one aspect according to any one of the preceding aspects the thrust portion (21) and/or the grip portion (10*a*), at least in the locking condition, are configured for guiding the insertion of the opening device (19) in interposition between the first and the second coupling portions (12, 13).

In one aspect according to any one of the preceding aspects the opening device (19) is insertable, at least in the locking condition, through the through access (26) in interposition between the second panel (13*b*) of the second coupling portion (13) and the first coupling portion (12) to allow the disengagement of said first coupling portion (12) and said second coupling portion (13). In one aspect according to any one of the preceding aspects the opening device (19) is insertable, at least in the locking condition, directly within the seat (40) of the second coupling portion (13) to allow the extraction of the first coupling portion (12). In one aspect according to any one of the preceding aspects the opening device (19) comprises:

at least one grip portion (19*a*) configured for allowing the user to manually grasp the opening device (19), at least one unlocking portion (19*b*), emerging from the grip portion (19*a*), configured for being inserted, in the locking condition, through the through access (26) in interposition between the first and the second coupling portions (12, 13).

In one aspect according to any one of the preceding aspects the grip portion (19*a*) has a size greater than a passage section of the through access (26). In one aspect according to any one of the preceding aspects only the unlocking portion (19*b*) of the opening device (19) is configured for traversing, at least in the locking condition, the through access (26) to be inserted in the internal volume of the storage.

In one aspect according to any one of the preceding aspects the opening device has a substantially "T" shape. In one aspect according to any one of the preceding aspects the opening device (19) is made of sheet material. In one aspect according to any one of the preceding aspects the opening device (19) comprises (is defined by) a tongue made of sheet material, optionally paper. In one aspect according to any one of the preceding aspects the opening device (19) comprises at least two sheets that are superimposed on and engaged with each other. In one aspect according to the preceding aspect the unlocking portion (19*b*) of the opening device (19) is configured for being inserted, in the locking condition, through the through access (26) in interposition between the second panel (13*b*) and the first coupling portion (12), optionally within the seat (40), to allow the disengagement between said first coupling portion (12) and said second coupling portion (13). In one aspect according to any one of the preceding aspects the grip portion (19*a*) of the opening device (19), in the closed condition of the closure system (7) and when the unlocking portion (19*b*) is inserted in interposition between the second panel (13*b*) and the first coupling portion (12), is configured for remaining outside the internal volume of the storage (3).

In one aspect according to any one of the preceding aspects the container (1) comprises at least one pocket (30) configured for housing at least partly the opening device (19). In one aspect according to any one of the preceding aspects the pocket (30) is defined on the storage (2), optionally in the internal volume (3). In one aspect according to any one of the preceding aspects the pocket (30) comprises at least one slit of through type made on the storage and configured for allowing the at least partial insertion of the opening device (19) in the internal volume of the storage. In one aspect according to any one of the preceding aspects the element for gripping the pocket (30) is configured for receiving the entire unlocking portion (19*b*) and only a part of the grip portion (19*a*) of the opening device (19), in which said opening device (19), when engaged in the pocket, has a part of the grip portion (19*a*) arranged outside the internal volume (3) of the storage.

In one aspect according to any one of the preceding aspects the front wall (4*a*) comprises, at and in continuity with the free edge (6), a depression (23). In one aspect according to any one of the preceding aspects the depression (23) is configured to allow the user, in the locking condition, to grip the closure system (7) to allow, following the disengagement of the first and second coupling portions (12, 13) the extraction of the first coupling portion (12) from the internal volume of the storage. In one aspect according to any one of the preceding aspects the depression (23), in the closed condition, is configured to allow the at least partial display of the closure system (7) which is visible and reachable by the user from outside the container. In one aspect according to any one of the preceding aspects the depression (23), in the locking condition, is configured to allow the at least partial display of the inserting portion (10) of the closure system (7).

In one aspect according to any one of the preceding aspects the first and the second coupling portions (12, 13) are configured to reversibly pass from the closed condition to the open condition. In one aspect according to any one of the preceding aspects, between the hooks respectively of the first and of the second coupling portion (12, 13), there are no weakening portions and/or removable portions.

In one aspect according to any one of the preceding aspects the hook (16*a*) of the second coupling portion (13) has, when the second coupling portion (13) is in the releasing position, an angular offset with respect to the front wall (4*a*) of the storage (2) greater than an angular offset of the same hook (16*a*) with respect to the same front wall (4*a*) when the second coupling portion (13) is placed in the locking position; optionally said angular offset being an internal angle (optionally the smaller angle) measured in interposition between the front wall (4*a*) of the storage (2) and the same hook (16*a*).

In one aspect according to any one of the preceding aspects the second coupling portion (13) is only carried by the front wall (4*a*) of the storage (2). In one aspect according to any one of the preceding aspects the base (25) is directly fixed to the front wall (4*a*) of the storage (2), optionally by means of glue. In one aspect according to any one of the preceding aspects the base (25) is directly joined to a section of the free edge (6) of the front wall (4*a*).

In one aspect according to any one of the preceding aspects the container comprises at least one removable tongue (15) engaged with the closure system (7). In one aspect according to the preceding aspect the removable tongue (15) is placed to at least partially close the through access (26). In one aspect according to the two preceding aspects the removable tongue (15) is configured to be completely separated from the closure system (7). In one aspect according to the preceding three aspects the removable tongue (15) is configured to be separated from the closure system, in the locking condition, following an intervention attempt by the user, optionally on the thrust portion (21). In one aspect according to the four preceding aspects the removable tongue (15) is configured to be separated from the closure system, in the locking condition, following an intervention attempt, manual and/or by means of an opening device (19), by the user through the through access (26), optionally following an intervention attempt on the thrust portion (21). In one aspect according to the five preceding aspects the removable tongue (15) is placed within the through access (26). In one aspect according to the six preceding aspects the removable tongue (15) is integrally joined to the closure system (7) by means of at least one weakened portion. In one aspect according to the preceding aspect the weakened portion joined to the removable tongue (15) is configured for being broken following an intervention, optionally manual and/or by means of an opening device (19), on the removable portion itself (15) and/or following a passage attempt through the through access (26). In one aspect according to any one of the preceding aspects the removable tongue (15) is configured for indicating an attempt of first opening of the container.

In one aspect, a process is provided of making a container (1) according to any one of the preceding aspects. In one aspect according to any one of the preceding aspects the process comprises at least the following steps:

providing the storage (2), providing the closure system (7).

In one aspect according to any one of the preceding aspects the step of providing the storage comprises at least the following sub steps:

providing a first sheet (51) comprising at least one first and one second portion (52, 54) interconnected by a central connection portion (53), the first sheet (51) also comprising at least one first and at least one second lateral connection portion (55, 71), the second portion (54) being interposed between the first lateral connection portion (55) and the central connection portion (53), while the second lateral connection portion (71) can be connected to the first lateral connection portion (55) or the first portion (52), each of said portions (52, 53, 54, 55, 71) comprising at least two opposite longitudinal edges and two opposite end edges, said portions (52, 54), central connection portion (53) and said first and second lateral connection portions (55, 71) being joined along the longitudinal edges and aligned along a single connection direction, folding the first sheet (51) along said longitudinal edges so as to arrange the lateral connection portion at the first portion (52), joining, for example by means of gluing, the second lateral connection portion (71) with said first portion (52) to define said storage.

In one aspect according to any one of the preceding aspects the step of providing the closure system (7) comprises the sub step of providing at least one second sheet (57) connected to an end edge of the first portion (52), the second sheet (57) comprising a first and a second portion (58, 59) integrally joined to each other, the first portion (58) of the second sheet (57) being interposed between the first portion (52) of the first sheet (51) and the second portion (59) of the second sheet (57). In one aspect according to any one of the preceding aspects the step of providing the closure system also comprises the sub step of folding said first and second portion (58, 59) of the second sheet (57) so as to respectively form the closure portion (9) and the inserting portion (10).

In one aspect according to any one of the preceding aspects, the process comprises a step of providing the second coupling portion (13) which comprises the following steps:

providing a third sheet (60) connected to an end edge of the second portion (54) of the first sheet (51), the third sheet (60) comprising a first portion and a second portion (61, 62) which are respectively configured to define the first and the second panels (13*a*, 13*b*) of the second coupling portion (13), folding said third sheet (60) above the second portion of the first sheet (51), joining said third sheet (60) to said second portion (54) of the first sheet (51).

In one aspect according to any one of the preceding aspects the first portion (61) of the third sheet is interposed between the second portion (62) of the third sheet and the second portion (54) of the first sheet, in which the step of folding the third sheet comprises the following sub steps:

folding the first portion (61) of the third sheet above the second portion of the first sheet, constraining, for example by means of gluing, said first portion (61) of the third sheet to the second portion of the first sheet, folding the second portion (62) of the third sheet above the first portion of the third sheet, constraining, for example by means of gluing, the second portion (62) of the third sheet to the first portion of the same third sheet in a manner such that the first portion (61) of the third sheet can define the first panel (13*a*) while the second portion (62) of the third sheet can define the second panel (13*b*), the second portion (54) of the first sheet (51) defining the lateral wall of the storage directly carrying said second coupling portion.

In one aspect according to any one of the preceding aspects the first portion (61) of the third sheet (60) comprises a first notch (70) configured for defining a through groove adapted to define-following the folding of the third sheet (60)

the through opening of the first panel (13*a*). In one aspect according to any one of the preceding aspects the first portion (61) of the third sheet (60) comprises at least one second notch (75) configured for defining on the first portion of the third sheet:

at least one lateral shoulder (61*a*), at least one central body (61*b*) integrally joined with said shoulder and movable with respect to the latter due to the presence of said second notch (75), in which-following the folding of the third sheet (60)—the lateral shoulder (61*b*) is configured for defining the base of the first panel (13*a*) while the central body (61*b*) is configured for defining the main body (27) of the first panel (13*a*).

In one aspect according to any one of the preceding process aspects the second notch (75) also defines the second portion (62) of the same third sheet (60), the latter adapted to define the second panel (13*b*). In one aspect according to any one of the preceding process aspects the second notch (75) is extended, without interruption, partly on the first portion (61) of the third sheet (60) and partly on the second portion (54) of the first sheet.

In one aspect according to any one of the preceding aspects the first, the second and the third sheet are integrally joined to form a single sheet blank (50). In one aspect according to any one of the preceding aspects the blank (50) is attained by means of die cutting of a flat precursor sheet. In one aspect according to any one of the preceding aspects the blank (50) is entirely made of paper material. In one aspect according to any one of the preceding aspects the third sheet (60) comprises a third portion (62*a*) integrally joined to the second portion (62) and configured for defining the thrust portion (21). In one aspect according to the preceding aspect the second portion (62) of the third sheet (60) is interposed between the first and the third portion of the third sheet (60). In one aspect according to any one of the preceding process aspects the first notch (70) made on the first portion (61) of the third sheet (60) delimits the third portion (62*a*) which is configured for defining, following the folding of the third sheet itself, the thrust portion (21).

In one aspect according to any one of the preceding process aspects the step of providing the third sheet (60) comprises the following sub steps:

executing the first and second notch (70, 75) on the third sheet (60) to define the first, the second and the third portion (61, 62, 62*a*), folding the first and the second portion (61, 62) one above the other in a manner such that the latter can respectively define the first and the second panels of the second coupling portion (13) delimiting said seat (40), constraining, optionally by means of gluing, part of the first portion (61), optionally only the lateral shoulder (61*a*), of the third sheet (60) to the second portion (54) of the first sheet (51), constraining, optionally by means of gluing, the second portion (62) of the third sheet to the first portion (61) of the same third sheet (60).

In one aspect according to any one of the preceding process aspects the second portion (54) of the first sheet (51) defines the lateral wall of the storage (optionally the front wall 4*a*) directly carrying the second coupling portion (13). In one aspect according to any one of the preceding aspects, the first notch (70) is configured for defining the undercut (16) of the second coupling portion (13). In one aspect according to any one of the preceding process aspects the part of the second notch (75) which is extended on the second portion (54) of the first sheet (51) defines the depression (23) of the storage (2). In one aspect according to any one of the preceding aspects the process comprises a step of providing the first coupling portion (12) also comprises a step of providing a fourth sheet (63) comprising at least one portion (64) integrally joined to the second portion (59) of the second sheet (57) and configured for forming the first coupling portion (12). In one aspect according to any one of the preceding aspects the first portion (58) of the second sheet (57) comprises at least one notch (69) configured for defining the through access (26). In one aspect according to any one of the preceding aspects the first sheet (51) comprises a notch defined in interposition between the first portion (52) and the central connection portion (53) configured for defining the pocket (30). In one aspect according to any one of the preceding aspects the second notch (75) is defined at least partly on the second portion of the first sheet (51) and at least partly on the third sheet (60). In one aspect according to any one of the preceding aspects the first notch (70) defines at least part of the third portion (62*a*) of the third sheet (60). In one aspect according to any one of the preceding process aspects the first notch (70) is configured for defining both the through opening on the first panel (13*a*) and at least partly delimiting the thrust portion. In one aspect according to any one of the preceding process aspects, only following the superimposition, due to the folding action, of the first and second portion (61, 62) of the third sheet is the seat (40) of the second coupling portion (13) obtained.

In one aspect according to the preceding aspect the step for folding the third sheet (60) comprises the steps of:

folding the second portion (62) of the third sheet on the first portion (61) of the third sheet itself, constraining, for example by means of gluing, the second portion (62) of the third sheet (60) on the first portion (61) of the third sheet itself, jointly folding the first and the second portion of the third sheet (60) on the second portion (54) of the first sheet, constraining, for example by means of gluing, the first portion of the third sheet (optionally only the first portion 61) to the second portion (54) of the first sheet.

As an alternative to the step for making the second coupling portion (13) described above, the process can comprise the following steps of providing the second coupling portion (13), which comprises at least the following sub steps:

providing a third sheet (60) connected to an end edge of the second portion (54) of the first sheet (51), the third sheet (60) comprising a first portion (61), a second portion (62) and a third portion (62*a*), folding said third sheet (60) above the second portion of the first sheet (51), joining at least the second portion (62) of said third sheet (60) to said second portion (54) of the first sheet (51) in a manner such that said first and third portion can respectively define the hook (16*a*) of the second coupling portion (13) and the thrust portion (21).

In one aspect according to any one of the preceding aspects in which the step of providing the third sheet (60) comprises the following sub steps:

executing a notch (70) on the third sheet (60) and on at least part of the second portion (54) of the first sheet to define the first, the second and the third portion (61, 62, 62*a*), folding the first portion (61) in a manner such that the latter can define the base (25) of the second coupling portion (13), while the second portion (62) defines the main body (27) of the second coupling portion (13), constraining, optionally by means of gluing, the first portion (61) of the third sheet (60) to the second portion (54) of the first sheet (51).

In one aspect according to any one of the preceding process aspects the second portion (54) of the first sheet (51) defines the lateral wall of the storage (optionally the front wall 4*a*) directly carrying the second coupling portion (13). In one aspect according to any one of the preceding process aspects the second portion (54) of the first sheet (51) comprises at least one notch (73) defining the depression (23), in particular the second portion (54) of the first sheet (51) comprises a notch (73) in proximity to each third sheet (60). In one aspect according to any one of the preceding process aspects the notch adapted to define said depression and the notch adapted to define said first, second and third portion (61, 62, 62*a*) of the third sheet (60) are joined together to essentially define a single through notch. In one aspect according to any one of the preceding aspects the first sheet (51) comprises a further notch (74) defined in interposition between the first portion (52) and the central connection portion (53) configured for defining the pocket (30). In one aspect according to any one of the preceding aspects the first, the second and the third sheet are integrally joined to form a single sheet blank (50). In one aspect according to any one of the preceding aspects the blank (50) is attained by means of die cutting a flat precursor sheet. In one aspect according to any one of the preceding aspects the blank (50) is entirely made of paper material.

In one aspect according to any one of the preceding process aspects the blank (50) comprises a fifth sheet integrally joined to the first sheet (51) configured for defining the opening device (19). In one aspect according to the preceding aspect the fifth sheet is obtained via die cutting of a single flat sheet, optionally in paper material. In one aspect according to any one of the preceding process aspects the blank (50) comprises a further notch (69) defined on the second sheet and adapted to define, following the folding of the second sheet itself, the through access (26). In one aspect according to the preceding aspect the further notch (69) is defined on at least one between the first and the second portion of the second sheet. In one aspect according to any one of the preceding process aspects the further notch (69) can define within the same a tongue (69*a*) configured for defining, following the folding of the second sheet itself, the removable tongue (15).

In one aspect, a method is provided for closing the container according to any one of the preceding aspects. In one aspect in accordance with any one of the preceding aspects the closing method comprises the step of inserting the first coupling portion (12) within the second coupling portion (13) in a manner such that said first and second coupling portions can stably be engaged with each other. In one aspect according to the preceding method aspects, the method comprises the insertion of the first coupling portion (12) in traversing the through opening defined by the hook (16*a*) and the base (25) to allow said first coupling portion (12) to be stably constrained to the hook (16*a*) of the second coupling portion (13) to define said locking condition.

In one aspect according to the preceding method aspects, the method comprises the insertion of the first coupling portion (12) in the seat (40) defined by the first and second panels (13*a*, 13*b*) of the second coupling portion.

In one aspect, a method is provided for opening the container according to any one of the preceding aspects. In one aspect according to any one of the preceding aspects the opening method comprises the steps of:

- thrustingly acting, from outside the container, on the thrust portion (21) to move at least part of the second portion of the locking position to the releasing position to allow the disengagement of the first and second coupling portions,
- extracting the first coupling portion (12) from the internal volume of the storage and consequently moving the closure system from the closed condition to the open condition.

In one aspect according to any one of the preceding aspects the step of acting thrustingly on the thrust portion (21) can be executed:

- by means of the insertion of at least one opening device (19) through the through access (26), in interposition between the first and the second coupling portions (12, 13),
- manually by the user.

In one aspect according to any one of the preceding aspects the thrusting action on the thrust portion (21) allows moving the at least one hook (16*a*) of the second coupling portion (13) away from the lateral wall of the storage directly carrying said second coupling portion, optionally away from the front wall (4*a*). In one aspect according to any one of the aspects of the opening method, the first coupling portion (12)—during the extraction step—is made to pass through the through opening defined by the hook (16*a*) and by the base (25). In one aspect according to any one of the aspects of the opening method, the manual movement of the thrust portion (21) allows the movement of said portion along at least part of the depth of the through access to allow the movement of the main body (27) (optionally the movement provides for the increase of the tilt of the main body 27 with respect to the front wall 4*a* of the storage).

BRIEF DESCRIPTION OF THE DRAWINGS

Several embodiments and several aspects of the finding will be described hereinbelow with reference to the enclosed drawings, provided only as a non-limiting example, in which:

FIGS. 9-9B are different perspective views of a container in accordance with the first embodiment, obtainable by means of the blank of FIG. 8;

FIG. 10 shows a variant of a container in accordance with the first embodiment;

FIGS. 13 and 14 show an embodiment variant of a container in accordance with the first embodiment;

FIGS. 16 and 17 show a container in accordance with the second embodiment, attainable by means of the blank of FIG. 15;

FIG. 20 is a detail in cross section of the container of FIG. 16, arranged in a locking condition FIG. 21 is a sectional view of the container in accordance with the second embodiment.

DEFINITIONS AND CONVENTIONS

Figure 1:
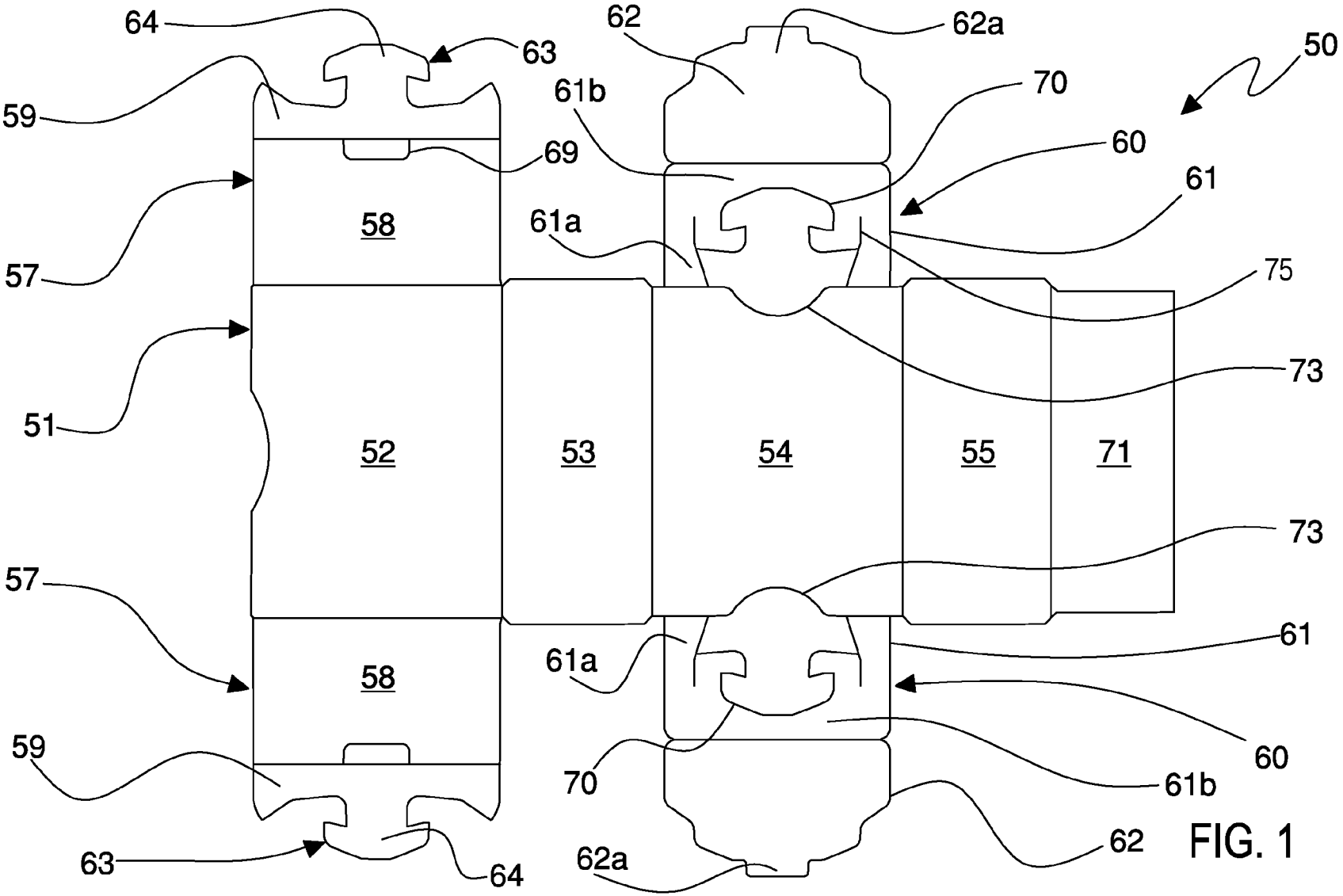
FIG. 1 shows a blank for making a container in accordance with a first embodiment.

It is observed that in the present detailed description, corresponding parts illustrated in the various figures are indicated with the same numeric references. The figures could illustrate the object of the invention by means of representations that are not in scale; therefore, parts and components illustrated in the figures relative to the object of the invention might only regard schematic representations.

With the term "product" it is intended paper or cardboard, e.g. having at least 50% by weight, optionally at least 70% by weight, of organic material comprising one or more from among cellulose, hemicelulose, lignin, lignin derivatives.

The paper material can be made of sheet material having a basis weight comprised between 100 and 500 g/m$^2$. The paper sheet material can be covered at least partly by means of a coating made of plastic material, e.g. a film, whose object is that of: reinforcing the paper sheet material, defining a water and/or moisture barrier. The coating can have a thickness variable between 10 and 50 μm and can be made with one or more of the following materials: LDPE, HDPE, PP, PE With reference to the present invention, the term "blank" refers to a flat semifinished product made of sheet material, for example made of paper sheet material, foldable on itself to make a container. The blank can be made of a single piece and obtainable by means of die cutting a single sheet. With the term "sheet material" it is intended a material that has two dimensions, for example the length and the width, considerably larger than a third dimension, such as the thickness.

With the term "opening device" it is intended any one tool usable by a user for opening the package. For example, the opening device can comprise at least one selected from the group between: a body made of sheet material (e.g. a payment card, a loyalty card or a suitable key), an elongated body (e.g. a pen or a suitable key). With the term "manually intervening" or "manual intervention" referred to the user, it is intended a manual action performed by the user without the aid of tools, such as an opening device.

DETAILED DESCRIPTION

Container 1

Reference number 1 overall indicates a child-proof container. The container 1 comprises a storage 2 made of sheet material, optionally made of paper sheet material, defining an internal volume 3 configured for housing one or more products. The storage 2 represents the compartment of the container 1 configured for housing one or more products. The storage 2 comprises a predetermined number of lateral walls defining at least one passage opening 5 delimited by a free edge 6. The storage 2 can have a parallelepiped shape, for example it can have, as illustrated in the enclosed figures, a shape substantially as a rectangular parallelepiped defined by a front wall 4*a*, a rear wall 4*b* opposite the front wall 4*a*, a first and a second lateral wall 4*c*, 4*d* opposite each other and connected to the front and rear wall 4*a*, 4*b*. Alternatively, the storage 2 can comprise a number of walls different from four. The walls 4*a*, 4*b*, 4*c*, 4*d* delimited said at least one passage opening 5 configured for placing the internal volume 3 of the storage 2 in communication with the external environment. For example, the container 1 illustrated in FIGS. 13 and 14, comprises a single passage opening 5; on the side opposite said single passage opening, the storage 2 has a closed bottom wall 90 configured for obstructing the storage on the side opposite said single passage opening 5. FIG. 14 shows an embodiment variant of the storage 2 in which the bottom wall 90 has an inlet 91 configured for allowing a user to at least partly enter into the internal volume of the storage 2 to push the products towards the passage opening 5.

In one embodiment, the container 1 comprises a drawer 92, at least partly counter-shaped with respect to the storage, configured to be inserted in the storage and at least partly contain the products; the drawer 92, can comprise a thrust wall 93 configured for facing the inlet 91; the user, following the opening of the container, can thrustingly act on the drawer 92 by means of thrusting against the thrust wall 93 to guide the drawer at least partly in outlet to the storage 2 and then carry at least part of the products to the passage opening 5. In this manner, the drawer 92 allows the user to carry the products to the opening 5, facilitating the pickup thereof.

Figure 2:
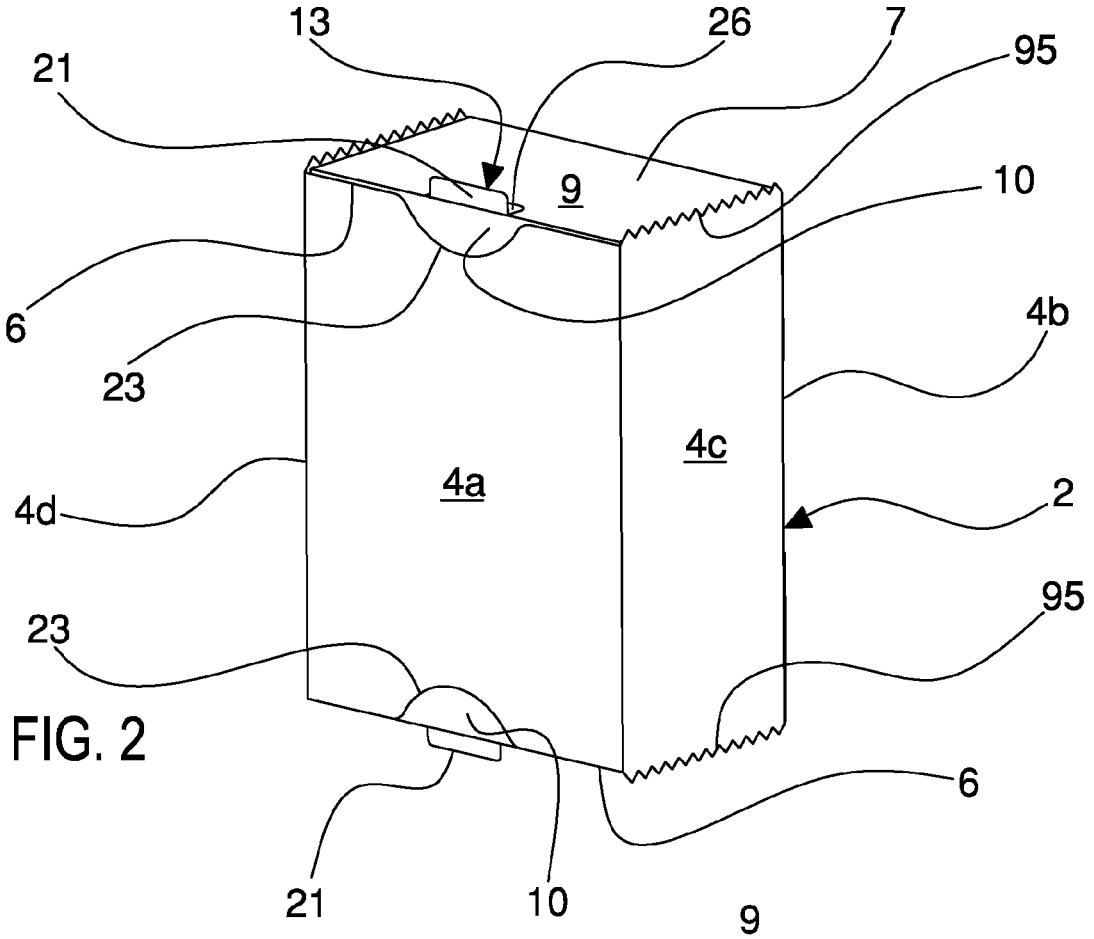
FIG. 2 is a perspective view of a container in accordance with a first embodiment, obtainable by means of the blank of FIG. 1.
Figure 7:
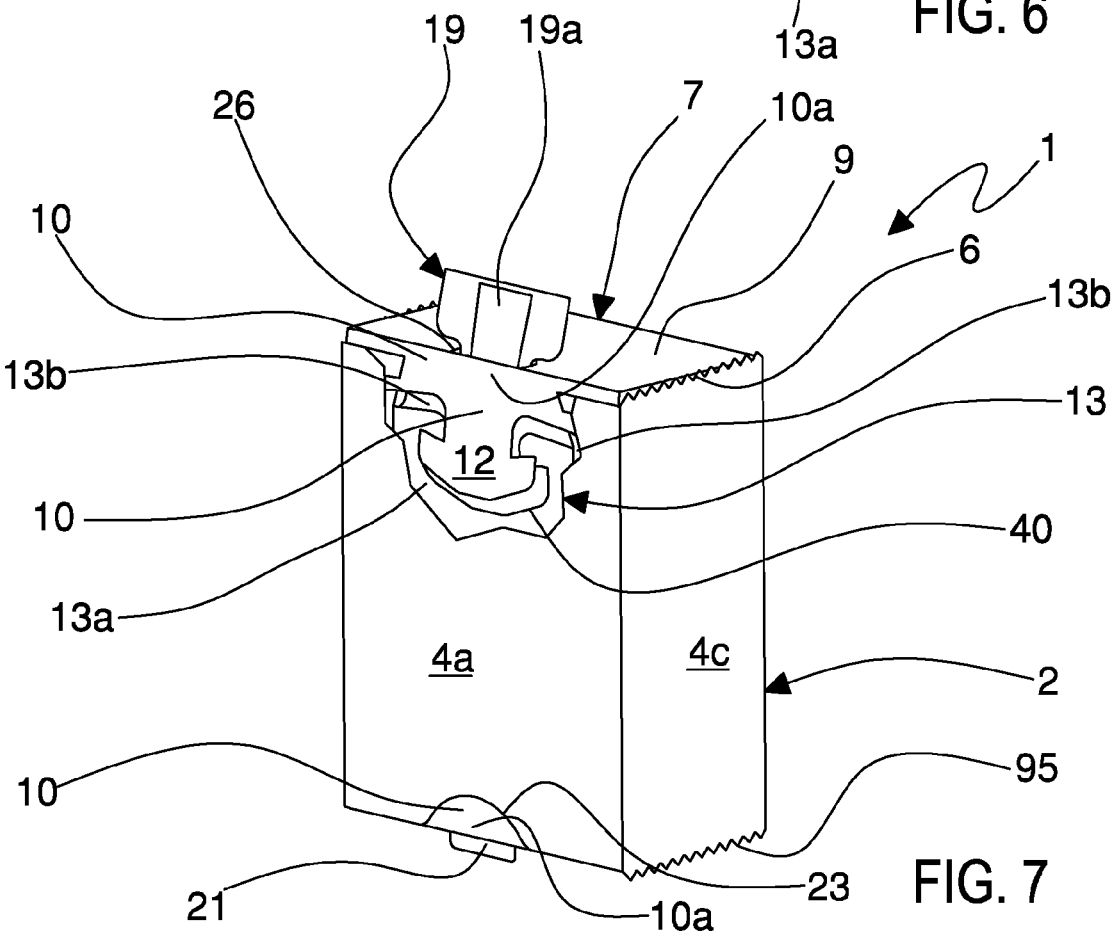
FIG. 7 is a cross section of the container of FIG. 2, during an open condition executed by means of an opening device.

Alternatively, as shown for example in FIGS. 2 and 7, the storage 2 can have two passage openings 5 respectively defined at opposite longitudinal ends of the storage 2 itself. Each passage opening 5 is delimited by a respective free edge 6: the passage openings 5 are opposite each other with respect to the storage 2 in a manner such that the latter substantially defines a duct or tube laterally delimited by the walls 4*a*, 4*b*, 4*c*, 4*d* and open at opposite longitudinal ends. Nevertheless, it may be possible to make, for example, a storage 2 having a single passage opening 5 or a number of openings 5 greater than two.

In an embodiment shown in FIGS. 2-5, at least part of the free edge 6 has a serration 95 configured for discouraging a child from inserting his/her finger and preventing an opening of the container. In particular, at least the free edge section 6 delimiting the first and the second lateral wall 4*c*, 4*d* has a sawtooth profile.

Furthermore, at least the front wall 4*a* can comprise a depression 23 defined at the free edge 6 and configured for allowing a user to grip on a closure system 7 (subsequently described) to allow the opening of the container 1. In particular, the front wall 4*a* can comprise a depression 23 defined at each passage opening 5. The depression 23 can have a substantially "C", "U" or "V" shape.

As mentioned above, the container 1 also comprises at least one closure system 7 made of sheet material, optionally made of paper sheet material, engaged at the free edge 6 and movable via rotation with respect to the storage 2. The closure system 7 is configured for defining at least one closed condition (see for example FIGS. 2, 3, 5, 6, 9, 10, 13, 16-21) in which the closure system 7 itself prevents the communication between the internal volume 3 of the storage 2 and the external environment and at least one open condition (see for example FIGS. 9A and 9B) in which the closure system 7 allows the communication between the internal volume 3 and the external environment. With regard to function, the closure system 7 substantially represents a lid adapted to cooperate with the storage 2 and adapted to manage the access to the internal volume 3. The container 1 can comprise a closure system 7 for each passage opening 5 of the storage 2. In the configuration of the container 1 having two passage openings 5, said container 1 has two closure systems 7 engaged with respective longitudinally opposite free edges 6 of the storage 2. The closure systems 7 are therefore arranged opposite each other with respect to the storage 2 itself. Each closure system 7 can be integrally joined to the storage 2. In the enclosed figures, each closure system 7 is integrally joined to the free edge 6 and is movable via rotation around it at least between the closing and opening conditions.

In one embodiment of the invention not shown in the enclosed figures, the closure system 7 is removably engageable with the storage 2 in a manner such to selectively obstruct the passage opening 5. In particular, the closure system 7 however has a plurality of lateral walls defining a space counter-shaper with respect to the passage opening 5 and configured for housing at least partly the storage 2. The closure system therefore prevents the insertion and the pickup of products from the storage.

In more detail, the closure system 7 comprises a closure portion 9 made of sheet material directly engaged and integrally joined to the free edge 6 of the storage 2: in detail, the closure portion 9 is directly hinged to the free edge 6 to allow the relative rotation between closure system and storage. The closure portion 9 is configured for preventing, in the closed condition, the access to the internal volume 3 of the storage 2. The closure portion 9 has a rectangular profile entirely counter-shaped with respect to the free edge 6. At least part of the rectangular profile of the closure portion 9 can have a sawtooth form, configured for discouraging a child from inserting his/her finger and hence preventing forced openings of the container by means of the lifting of the closure portion itself.

Figure 18:
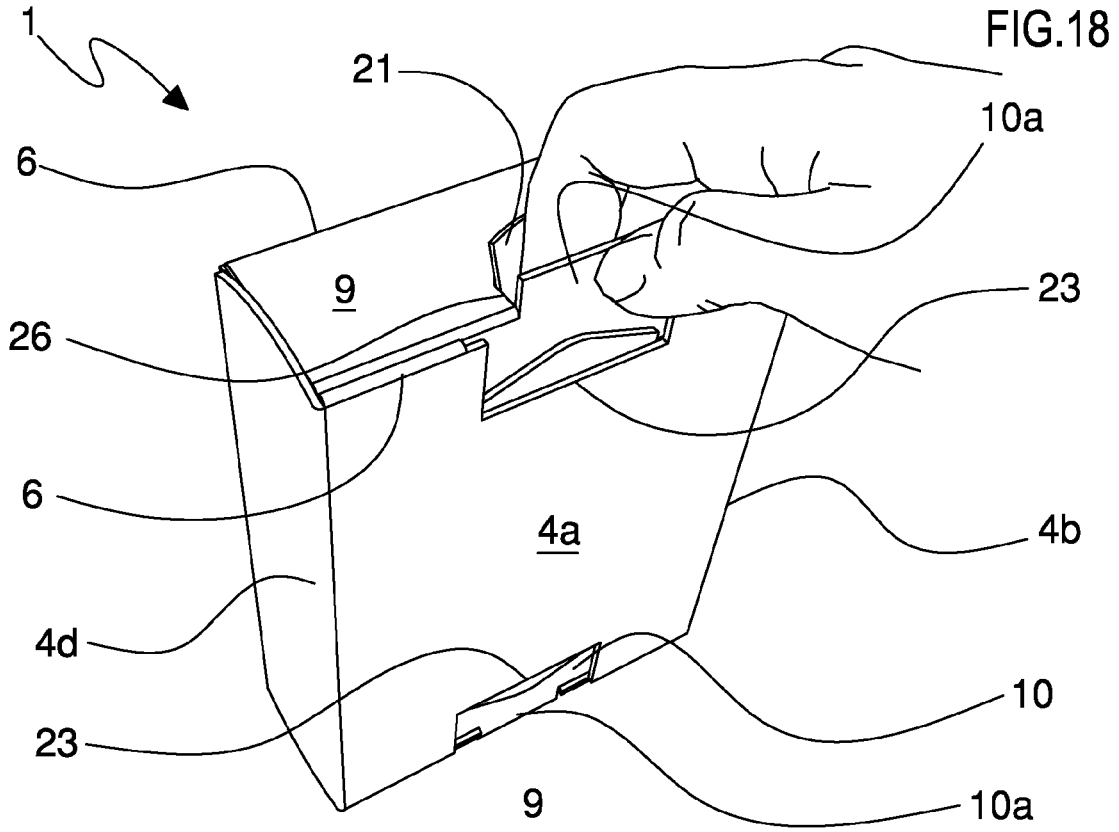
FIGS. 18 and 19 show steps for opening the container of FIG. 16.

The closure system 7 also comprises an inserting portion 10 configured for being inserted, in the closed condition, in the internal volume 3 of the storage 2. The inserting portion 10 is integrally joined to the closure portion 9 and emerges from the latter on the side opposite the free edge 6. The inserting portion 10 is extended from the closure portion 9: in the closed condition, the inserting portion 10 is positioned completely in the internal volume 3 of the storage 2, directly facing the recess 23. Also the inserting portion 10 substantially comprises a flat sheet having substantially rectangular shape. It is intended that further shapes can be provided for the inserting portion 10, e.g. a square or trapezoidal shape. The closure portion 9 and the inserting portion 10 have a fold edge 9*a* opposite the free edge 6 of the storage 2 with respect to the same closure portion 9: the inserting portion 10 is movable via rotation with respect to the closure portion 9 around the fold edge 9*a*. The inserting portion 10, in the closed condition, is configured for defining, according to a cross section and in cooperation with the closure portion 9, a substantially "L" shape (see for example FIG. 6). In detail, as is visible for example in FIGS. 6 and 9A, the closure system 7 is directly constrained to the rear wall 4*b*; the inserting portion 10, in the closed condition, is extended substantially parallel to the front wall 4*a* of the storage 2. As is visible in FIGS. 5, 7, 9, 10, 13, 14, 16 and 18, the inserting portion 10 can have at least one grip portion 10*a* configured for allowing a user, at least in the locking condition of the container 1, to grip the closure system 7 and extract the inserting portion 10 from the internal volume of the storage 2. The grip portion 10*a* can emerge, at least during the closed condition, from the free edge 6 of the resulting storage, at least during the locking condition, and at least partly faces a thrust portion 21, the latter subsequently detailed. In FIGS. 2, 3, 9A and 9B, the grip portion 10*a* is illustrated as arranged at the free edge 6; in detail, the grip portion is defined at the depression 23: the depression 23 provides the user with space for grasping the grip portion 10*a* and thus allows the movement of the closure system 7 from the closed condition to the open condition. In FIGS. 13, 16 and 18, the grip portion 10*a*, in the closed condition of the system 7, emerges from the free edge 6 to define an actual projection of the closure system 7 that is easily graspable by the user in the closed condition of the container (see for example FIG. 18).

In fact, during the closed condition, the grip portion 10*a* can be configured to facilitate a user in gripping the inserting portion 10 and the extraction of the latter from the internal volume 3. The grip portion 10*a* is integral with the inserting portion 10 and lacks weakening portions configured to allow the facilitated breakage of at least one of said inserting portion 10 and grip portion 10*a* the inserting portion 10 and the grip portion 10*a* lie on a single extension plane. It is observed that in one embodiment of the invention, the inserting portion 10 can lack a grip portion 10*a*: the grip of the inserting portion 10 by a user, during the closed condition, is allowed by the recess 23.

As alternative or in addition to the grip portion 10*a* of the inserting portion 10, the closure system 7 can have a grip portion 9*b* defined at least partly on the closure portion 9 of the system 7 (see for example FIGS. 9, 10 and 13), which is also configured for allowing a user to move said closure system 7 from the closed condition to the open condition; in detail, the grip portion 9*b* is configured for allowing a user to grasp and thrustingly act on the closure system 7 to allow the extraction of the inserting portion 10 from the internal volume 3 of the storage 2.

The inserting portion 10 can also comprise at least one peripheral tab 20 extended from the inserting portion 10 starting from a perimeter portion of the latter, configured for guiding said inserting portion 10 itself in the internal volume of the storage 2. In detail, as shown in the enclosed figures, the inserting portion 10 comprises two peripheral tabs 20 that are opposite each other with respect to a central zone of the inserting portion 10.

As is visible from the enclosed figures, the container 1 also comprises a through access 26 defined on the closure system 7, in particular defined, in the closed condition, at the free edge 6 of the storage 2.

The through access 26 can be defined entirely on the inserting portion 10 (FIGS. 16-21); in such configuration, the through access 26 is extended starting from the fold edge 9*a* towards a central zone of the inserting portion 10 to define a depth of said through access 26; the ratio between the depth of the through access 26 and a depth of the inserting portion 10, measured along the depth of the through access 26, can be comprised between 0.3 and 1. In such configuration, at least one section of the through access 26 can be delimited by the grip portion 10*a* of the inserting portion 10.

The through access 26 can be entirely on the closure portion 9 (condition not illustrated in the enclosed figures); in such configuration, the through access 26 is extended starting from the fold edge 9*a* towards a central zone of the closure portion 9 (towards the free edge section 6 delimited by the rear wall 4*b*) to define a depth of said through access 26; the ratio between the depth of the through access 26 and a depth of the closure portion 9, measured along the depth of the through access 26, is comprised between 0.15 and 0.4. In such configuration, at least one section of the through access 26 can be delimited by the grip portion 9*a* of the closure portion 10. The through access 26 has a predetermined width measured along a direction parallel to the fold edge 9*a* of the closure system 7; the ratio between the width of the through access 26 and a width of the closure portion 9, measured along the width of the through access, is comprised between 0.15 and 0.5, optionally comprised between 0.2 and 0.45.

The through access 26 can also be defined at least partly on the inserting portion 10 and at least partly on the closure portion 9 (see for example FIGS. 9-10 and 13); said through access 26 comprises a single opening passing through thickness of the closure system 7 and delimited by a single perimeter edge with closed profile; in detail, the through access 26 is arranged entirely within an outer perimeter edge of the closure system 7. The through access 26 can have a substantially square or rectangular shape (see for example FIG. 4) or substantially "T" shape; the access can have a linked shape as is illustrated in FIGS. 9, 10, 13 and 17.

As will be better described hereinbelow, the through access 26 is configured to allow the user, in the locking condition of the container, to reach the internal volume 3 of the storage 2 to reach closure components of the container so to allow the unlocking and the consequent opening. The through access 26 is also configured for allowing a user from outside the container to grasp the grip portion 10*a* of the inserting portion 10 and/or thrustingly act on the grip portion 9*b* of the closure portion 9 to allow the movement of the closure system from the closed condition to the open condition; in fact, the through access 26 is also configured to allow the extraction of the inserting portion from the internal volume 3 of the storage to allow the opening of the container. The container 1 also comprises at least one first coupling portion 12 carried by the closure system 7 and at least one second coupling portion 13 carried by the storage 2. The first and the second coupling portions 12, 13 are configured for being stably engaged with each other during a closed condition (see for example FIGS. 5, 6, 17, 19 and 20) to define a locking condition of the container in which the opening of the latter is prevented by the engagement between the first and the second coupling portions 12, 13. In detail, in the closed condition, the first coupling portion 12 is configured for being inserted at least partly in the internal volume 3 of the storage 2 to be stably engaged with the second coupling portion 13.

Figure 6:
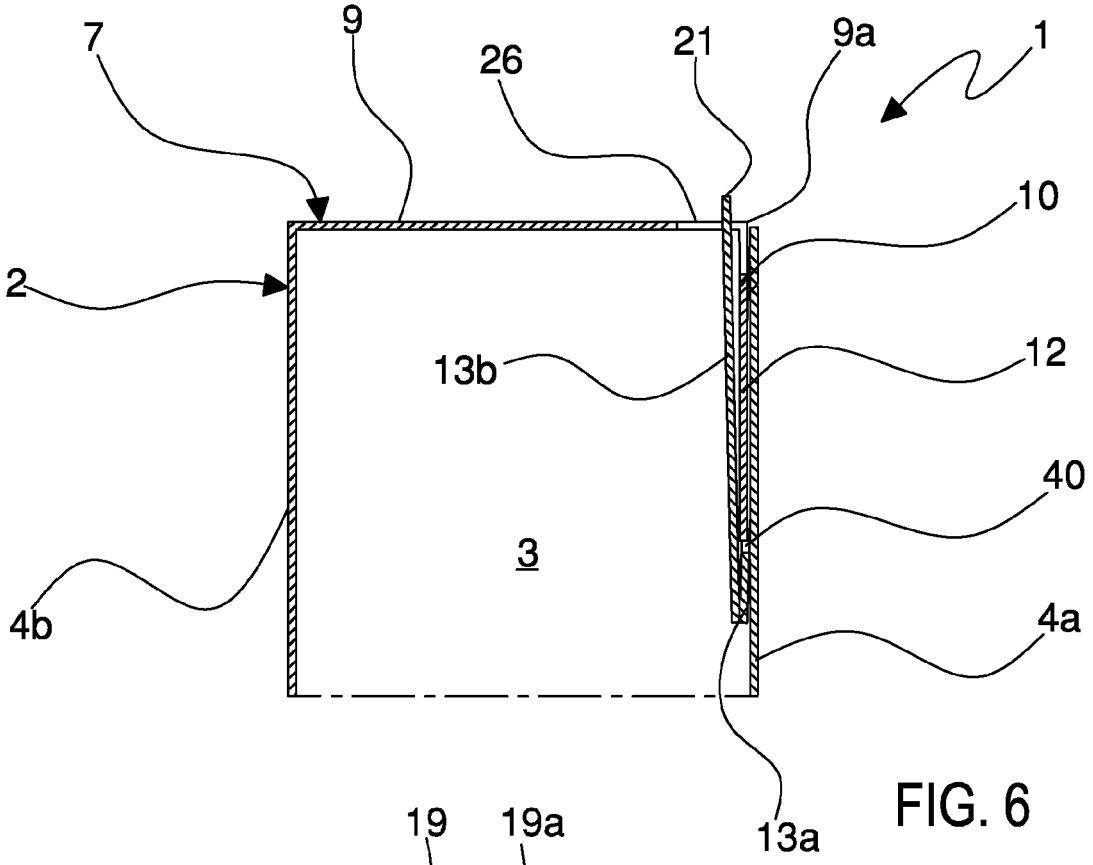
FIG. 6 is a sectional view of the container of FIG. 2.
Figure 19:
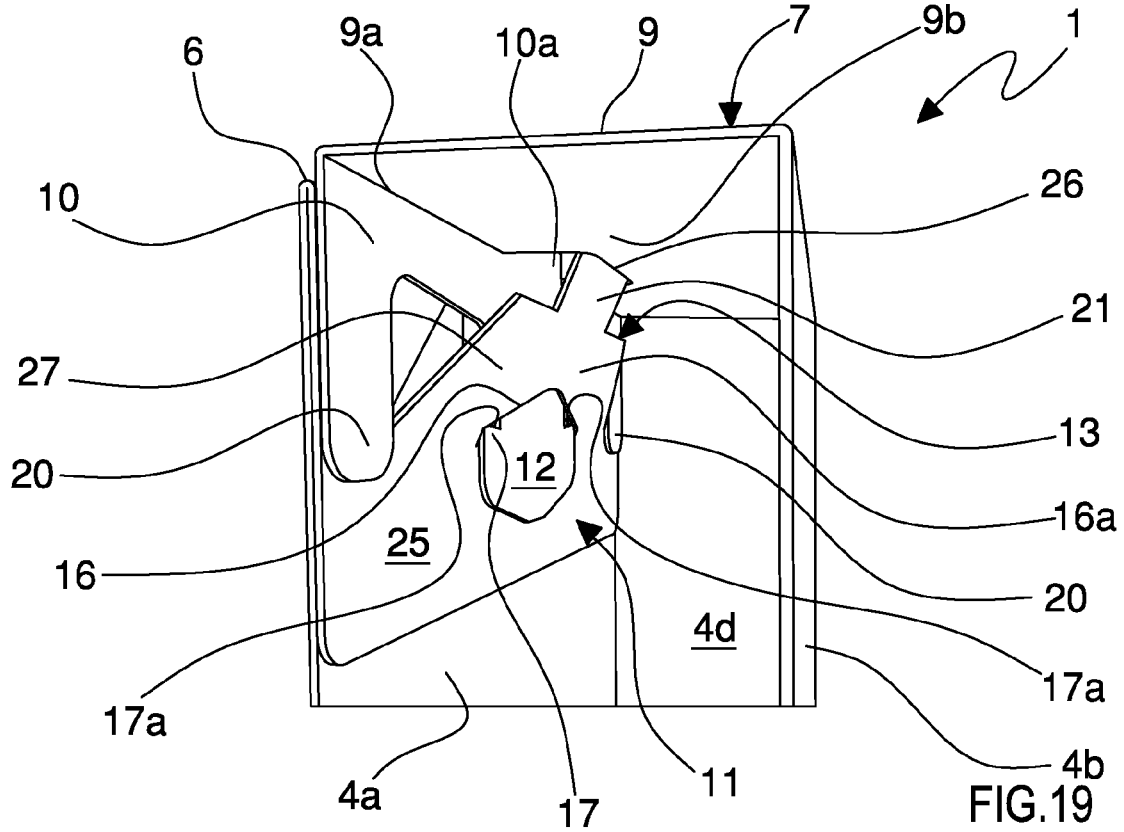

As illustrated for example in FIGS. 6, 17 and 19, in the closed condition, the first coupling portion 12 is entirely contained in the internal volume 3 of the storage 2 and is distanced from the free edge 6 of the storage 2. In addition, in the closed condition, the engagement between the first and the second coupling portions 12, 13 is completely defined in the internal volume 3 of the storage 2. The engagement between the first and the second coupling portions 12, 13 is of reversible type; in other words, after reaching the open condition, the first and the second coupling portions 12, 13 can be engaged to newly define the closed condition and, consequently, a new locking condition. This is possible since, upon the passage between the closed condition and the open condition, the first coupling portion 12 is simply disengaged from the second coupling portion 13. In other words, upon the passage between the closed condition and the open condition, the first and the second coupling portions 12, 13 are not removed or separated respectively from the closure system 7 and from the storage 2, but remain engaged with the latter. In this manner, since removable or weakened portions associated with said first and second coupling portions 12, 13 are not provided, the latter are configured to reversibly define, following each open condition, a locking condition in which such portions 12, 13 are stably engaged with each other.

The first coupling portion 12 is integrally joined to the closure system 7 and in particular directly carried by the inserting portion 10. In detail, the first coupling portion 12 and the inserting portion 10 can be integrally joined to form a single body. The first coupling portion 12 comprises a flat sheet body emerging, without interruption, from the inserting portion 10 opposite the closure portion 9. The inserting portion 10 is therefore interposed between the closure portion 9 and the first coupling portion 12. In fact, the first coupling portion 12 comprises a tongue made of sheet material, optionally paper, emerging from the closure system. The first coupling portion 12 comprises at least one undercut 17 configured for being engaged, in the closed condition of the container, with the second coupling portion 13 to define said locking condition. In detail, the undercut 17 of the first coupling portion 12 comprises at least one hook 17*a* having a substantially "C" shape profile whose concavity is directed—in the locking condition-towards the first and/or the second lateral wall 4*c*, 4*d* of the storage 2. In the endosed figures, a first coupling portion 12 is illustrated, having a shape substantially as an arrow or substantially "T" shaped or substantially "V" shaped having two undercuts 17 defining respective hooks 17*a* opposite each other with respect to a central portion of the first coupling portion 12; in the illustrated embodiment, the hooks 17*a* have respective concavities directed opposite each other. Each hook 17*a* of the first coupling portion 12 is configured for being stably engaged with the second coupling portion 13 at least partly arranged in the storage 2. In detail, each hook 17*a* of the first coupling portion 12, in the locking condition, is completely arranged in the internal volume of the storage 2. I n even more detail, each hook 17*a* of the first coupling portion 12, in the locking condition, is distanced from the free edge 6 of the storage 2.

As is visible from the enclosed figures, the second coupling portion 13 is at least partly arranged inside the storage 2 both in the closed condition and in the open condition. The second coupling portion 13 is directly engaged with the storage 2 and in particular constrained to the front wall 4*a* of the storage. Also, the second coupling portion 13 is made of sheet material, optionally made of paper sheet material.

The second coupling portion 13 defines at least one undercut 16 configured for stably engaging the first coupling portion 12, in the closed condition of the container, to define said locking condition. The second coupling portion 13 is at least partly movable with respect to the storage 2 at least between:

- a locking position in which the second coupling portion 13 allows the stable engagement between the undercut 16 and the first coupling portion 12, optionally preventing the disengagement thereof, and
- a releasing position in which the second coupling portion 13 allows the first coupling portion 12 to be disengaged from the undercut 16 to allow the passage of the closure system from the dosed condition to the open condition.

In fact, the mobility of at least part of the second coupling portion 13 allows the same to pass from an releasing position in which the same second coupling portion 13 is configured for receiving in engagement and releasing the first coupling portion 12 (optionally the at least one hook 17*a* of the first coupling portion 12) and the locking position in which said second coupling portion 13 is configured for retaining the first coupling portion 12 at least partly within the storage 2 in a manner such to prevent the opening of the closure system 7, in particular the passage of the closure system 7 from the closed condition to the open condition.

Hereinbelow, two possible embodiments of the second coupling portion 13 are described: a first embodiment is illustrated in FIGS. 2-7, 9-10, 13 and 14 while the second embodiment is illustrated in FIGS. 16-21.

Hereinbelow, the second coupling portion 13 is described in accordance with the first embodiment. The second coupling portion 13, in accordance with the first embodiment, comprises at least one first panel 13*a* integrally joined to the front wall 4*a* of the storage and which is entirely arranged in the internal volume 3 of the storage 2 substantially parallel to the front wall 4*a*. The first panel 13*a* comprises a through opening configured for insertingly receiving at least one part of the first coupling portion 12 to allow the engagement thereof with the second coupling portion 13. In detail, the through opening is delimited by a perimeter edge with open profile at least partly counter-shaped with respect to the first coupling portion 12: the through opening delimits at least partly the undercut 16 arranged within the storage 2, separate and distanced from the free edge 6. The undercut 16 defines substantially at least one hook 16*a* configured to allow, during the passage from the open condition to the closed condition, the insertion of the first coupling portion 12 for the stable engagement of the latter with the undercut 16 (with the at least one hook 16*a*) of the second coupling portion 13. As is visible from the enclosed figures, the undercut 16 defines at least two hooks 16*a*, separate from each other and distanced and configured for allowing, during the closed condition of the closure system 7, the stable engagement between the first and the second coupling portions 12, 13. The two hooks 16*a* have respective concavity directed opposite each other and are configured for stably engaging the respective hooks 17*a* of the first coupling portion 12 to define the locking condition of the container 1.

The first panel 13*a* can comprise at least one base 25 directly fixed, for example by means of gluing, to the front wall 4*a* of the storage 2; in particular, the base 25 can be a peripheral portion of the first panel 13*a*. The first panel 13*a* can further comprise at least one main body 27 carried by the base 25 and on which the undercut 16 is entirely defined. The main body 27 defines a central portion of the first panel 13*a* which nevertheless is not constrained to the front wall 4*a* of the storage: the first panel 13*a* is only constrained to the front wall 4*a* only by means of the base 25. The base and the main body of the first panel 13*a* are at least partly divided by means of a notch 13*c* (FIG. 9A) configured to allow a relative movement between the base and the main body; in the enclosed figures, a configuration has been illustrated in which the main body 27 is centrally placed with respect to the base 25 and at least partly divided from the latter by means of two opposite notches 13*c* (FIG. 9A).

The second coupling portion 13 furthermore comprises at least one second panel 13*b* engaged with the first panel 13*a* in a manner such that the latter is interposed between the front wall 4*a* and the second panel 13*b*. The second panel 13*b* is arranged at the through opening of the first panel 13*a*, extended along a direction parallel to the latter: the second panel 13*b* is arranged at the through opening of the first panel 13*a* to define, in cooperation with said through opening of the first panel 13*a*, a seat 40 configured for housing, during the closed condition of the closure system 7, the first coupling portion 12 to allow the stable engagement between the first and the second coupling portions 12, 13. The seat 40 is of blind type, i.e. not passing through the second coupling portion 13: in fact the second panel 13*b* defines a kind of stop panel for the first coupling portion 12 (for each hook 17*a* of the first coupling portion 12) while the first panel 13*a*-due to the presence of the through opening-delimits the undercut 16 adapted to allow the stable engagement of the first and second coupling portions 12, 13.

In fact, in the locking condition, the undercuts 16, 17-optionally the hooks 16*a* and 17*a*—are engaged with each other to allow the locking of the first and second coupling portions 12, 13. The second panel 13*b* is integrally joined to the first panel 13*a* and folded above the latter to define a folded portion (see for example FIGS. 6, 9A and 9B): the second panel 13*b*-superimposed on the first panel 13*a*—is only constrained, for example by means of gluing, to the single main body 27 of the same first panel 13*a*.

At least part of the first and of the second panel 13*a*, 13*b* of the second coupling portion 13 are movable with respect to the storage at least between:

- the locking position in which the first and the second panels 13*a*, 13*b* are adjacent to the front wall 4*a* of the storage 2, configured for allowing, in cooperation with the front wall 4*a*, the locking of the first coupling portion 12 within the seat 40,
- the releasing position in which the first and the second panels 13*a*, 13*b* are at least partly distanced from the front wall 4*a* to allow the extraction of the first coupling portion 12 from the seat 40.

Only the main body 27 of the first panel 13*a* and the entire second panel 13*b* are movable at least between the locking position and the releasing position, and vice versa, to allow the movement of the first coupling portion 12 outside the seat 40. Such movement can be executed due to the notch 13*c* of the first panel 13*a*, which allows the movement between the locking position and the releasing position of the main body 27 and of the second panel 13*b* with respect to the storage 2 and in particular with respect to the front wall 4*a* which directly faces the seat 40 of the second coupling portion 13.

As is visible from the enclosed figures, the seat 40 has a substantially "C" or "U" shape, delimited at least partly by the hook 16*a* of the undercut 16 of the first panel 13*a*: also the seat 40 can therefore be counter-shaped with respect to the first coupling portion 12, configured for entirely housing the latter. The opening of the container occurs following the lifting and extraction of the first coupling portion 12 from the seat 40 to allow the extraction of the inserting portion 10 from the internal volume 3 of the storage 2. It should be noted that the lifting of the second coupling portion 12 is an unnatural operation for a child, who mainly brought to press on the first coupling portion 12. In such a manner, a child would further push the first coupling portion 12 within the seat 40, thus maintaining it in engagement with the second coupling portion 13.

The second coupling portion 13 in accordance with the first embodiment can comprise a thrust portion 21 placed at the through access 26; the thrust portion 21 is configured for allowing the movement of at least part of said second coupling portion 13 itself from the locking position to the releasing position. In detail, the thrust portion 21, in the closed condition of the closure system 7, is configured for allowing a user to act, from outside the container, thrustingly on the thrust portion 21 itself to move the first and second panels 13*a*, 13*b* from the locking position to the releasing position so to execute the disengagement between the first and the second coupling portions 12, 13. The through access 26 is configured for allowing the access thereof to the internal volume 3 of the storage 2, as well as to allow a user to act on the thrust portion 21 to allow the disengagement of the first and second coupling portions 12, 13 and therefore the passage of the closure system 7 from the closed condition to the open condition. In other words, the through access 26 is thus configured for allowing a user, from outside the container, to execute the movement of the first and second panels 13*a*, 13*b* from the locking position to the releasing position due to the thrust portion which acts, as will be better described hereinbelow, as an element useful for the direct movement by the second coupling portion 13 or as an element for guiding at least one opening device 19.

The thrust portion 21 is carried directly by the second panel 13*b*; in detail, the second panel 13*b* of the second coupling portion 13 lies on an extension plane: the thrust portion 21 lies on a respective extension plane substantially parallel to, optionally coinciding with, the extension plane of the second panel 13*b*. The second panel 13*b* and the thrust portion 21 are defined by a single tongue made of sheet material, optionally paper. In fact, the thrust portion 21 emerges from the second panel 13*b*, in the locking condition of the container, in the direction of the closure system 7. The thrust portion 21, at least during the closed condition of the closure system 7 may:

- at least partly traverse said through access 26, optionally at least partly exit from the container (FIGS. 2, 3, 5 and 6). In such configuration, the thrust portion 21, in the closed condition of the closure system 7, at least partly traverses a through access 26, emerging from the internal volume 3 of the storage 2; or
- face said through access 26, without traversing it (see for example FIGS. 9 and 10).

Independent of the position and extension of the thrust portion 21 the same can be configured for allowing a user, in the locking condition and from outside the container, to manually intervene and/or by means of an opening device 19 on the thrust portion 21 to allow the movement of at least part of the second coupling portion 13 from the locking position to the releasing position: the thrust portion 21 is integrally movable with the second panel 13*b* at least between the locking position and the releasing position, and vice versa.

In fact, the thrust portion 21 is thus configured for allowing the rotation of the main body 27 of the first panel 13*a* and of the second panel 13*b* from the locking position to the releasing position.

Figure 3:
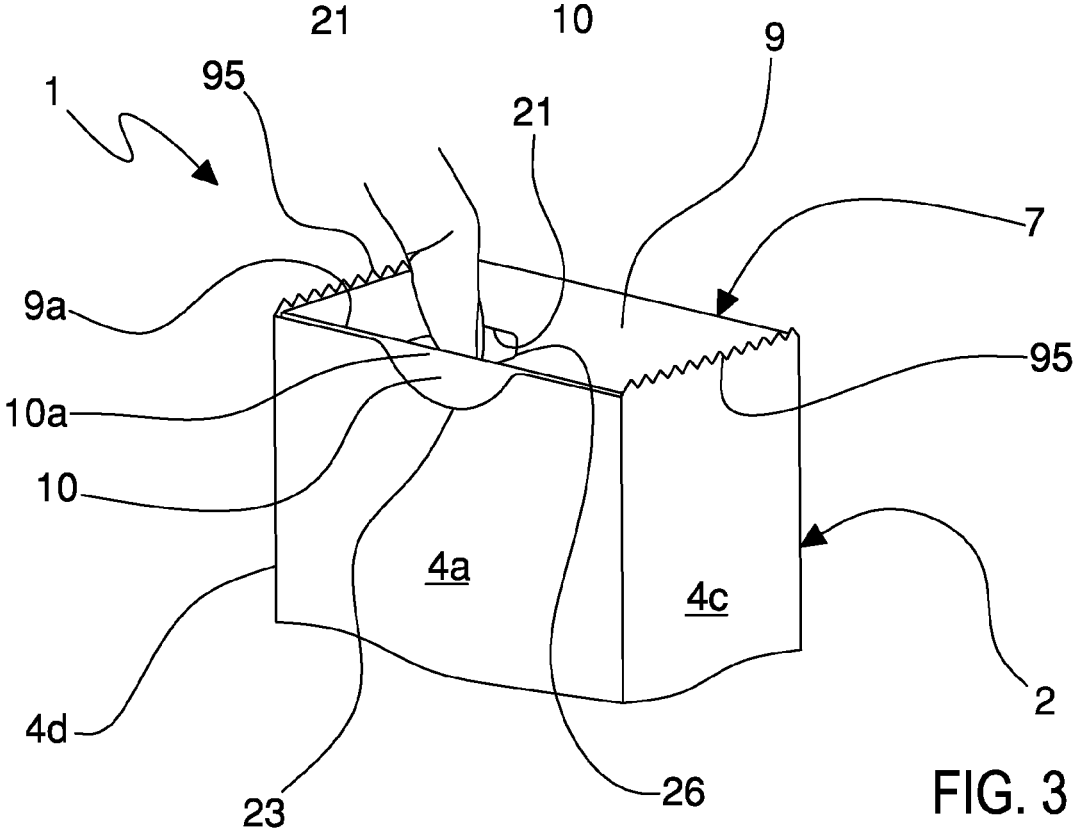
FIGS. 3 and 4 schematically show a step for opening the container of FIG. 2.
Figure 4:
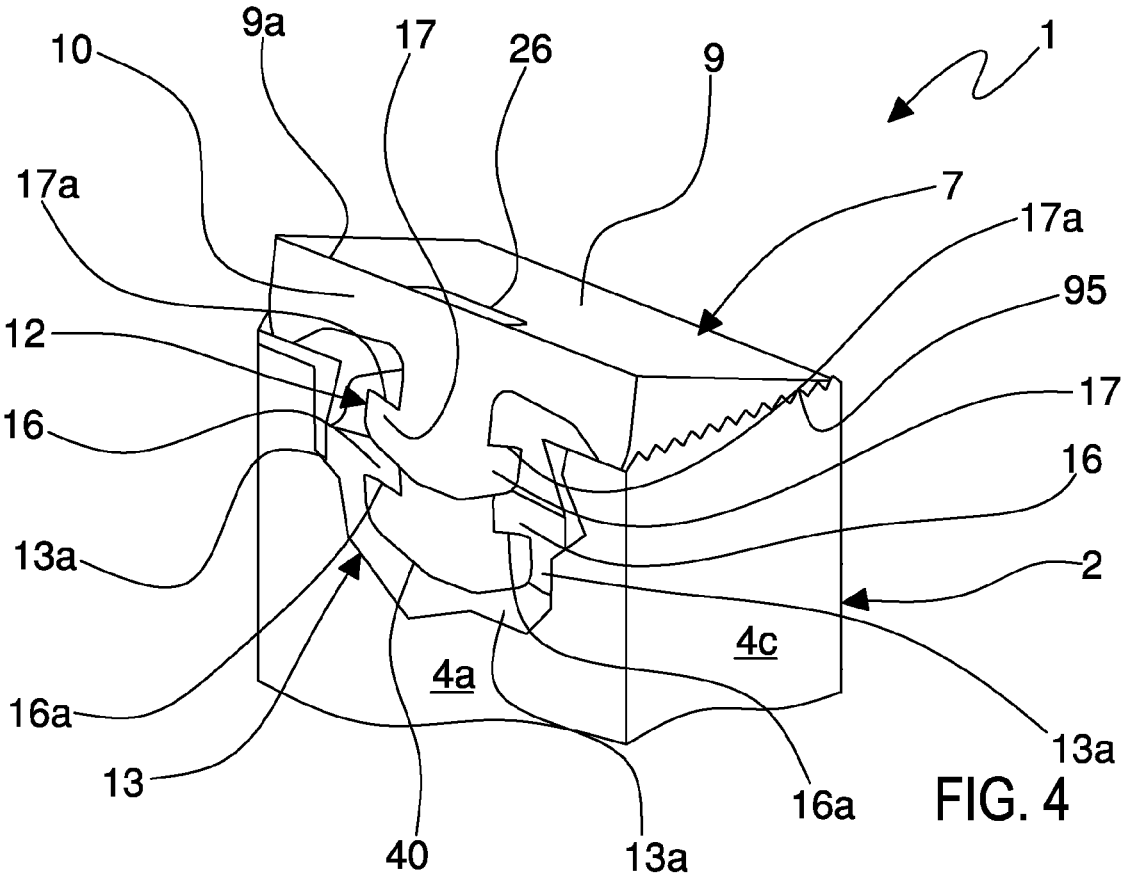
Figure 5:
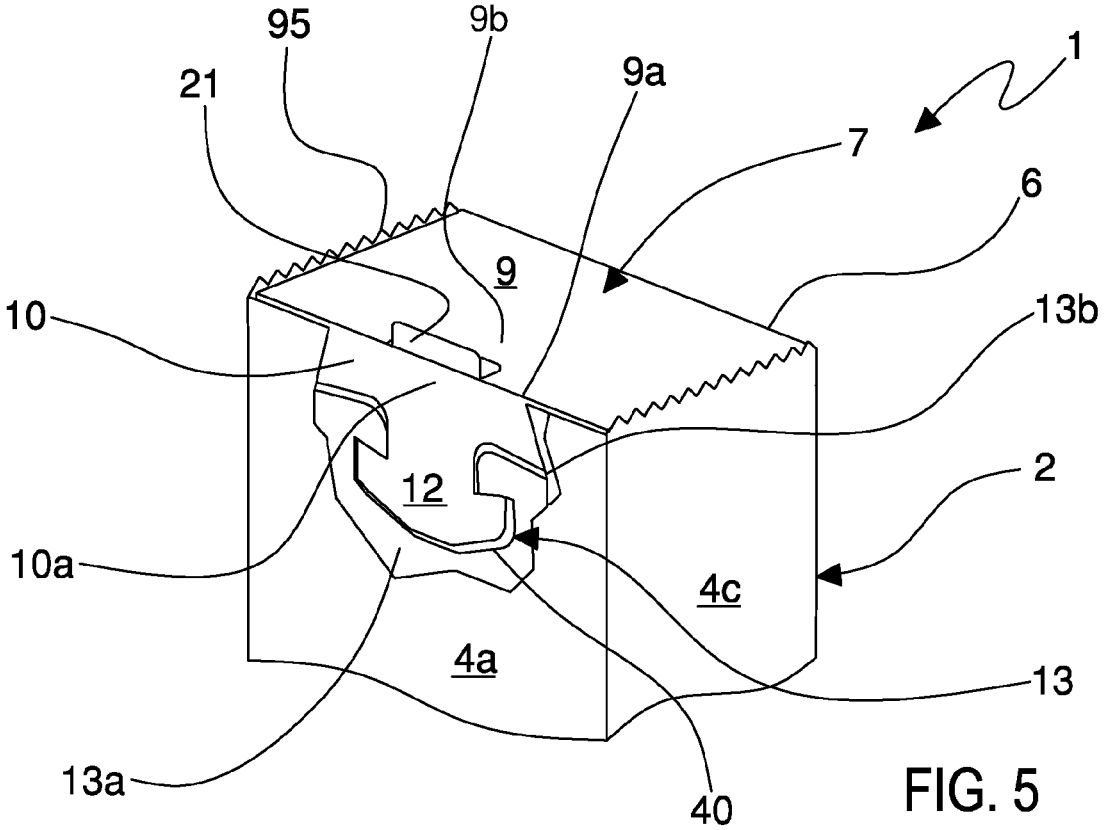
FIG. 5 is a perspective view in cross section of the container of FIG. 2 arranged in a locking condition.

FIGS. 2, 3 and 5 illustrate a thrust portion 21 which, in the locking condition, traverses the through access 26 and exits from the container. In such configuration, the thrust portion 21 can be moved, in the locking condition, manually by a user (see for example FIG. 2) to move the second coupling portion from the locking position to the releasing position, or it can essentially act as a guide portion adapted to abuttingly receive an opening device 19 (FIG. 7) to guide it in interposition between the first coupling portion 12 and at least one part of the second coupling portion 13 to allow the extraction of the first coupling portion 12 from the seat 40.

In such condition, the thrust portion 21, in the closed condition, traverses the through access 26 and partly projects from the closure system 7 by a predetermined height. In particular, the thrust portion 21 projects from the free edge 6 by a length parts to the predetermined height, a fraction of the predetermined extension of the same thrust portion 21. In fact, the thrust portion 21 is at least partly arranged in the internal volume 3 and partly arranged outside the storage:

the ratio between the height of the thrust portion 21 emerging from the free edge 6 of the storage 2 and the extension of the thrust portion itself is greater than 0.1, optionally comprised between 0.3 and 0.8. In other words, the height value of the thrust portion 21 emerging from the free edge 6 is greater than 2 mm, optionally comprised between 3 mm and 10 mm.

Alternatively, the thrust portion 21 can be arranged entirely in the internal volume 3 of the storage and arranged, in the locking condition, facing the through access 26 (see for example FIGS. 9 and 10): in such embodiment, the thrust portion 21 does not traverse the through access 26. In such condition, the through access 26 is configured for allowing a user to insert a finger or an opening device 19 at least partly within the internal volume 3 of the storage 2 and act on the thrust portion 21 to allow the movement of at least part of the second coupling portion 13 from the locking position to the releasing position and to extract the first coupling portion 12 from the seat 40.

As described above, each hook 17*a* of the first coupling portion 12 is configured for being constrained with at least one hook 16*a* of the first panel 13*a* to define the locking condition. In the closed condition of the closure system 7, the hook 17*a* is thus arranged within the seat 40 and abutted against a respective hook 16*a* of the first panel 13*a* to define the stable engagement between the first and the second coupling portions 12, 13. The opening of the container 1 occurs following the extraction of the hook 17*a* of the first coupling portion 12 from the seat 40, allowing the disengagement with the respective hook 16*a* of the first panel 13*a* of the second coupling portion 13. Such step for extracting the hook 17*a* of the first portion 12 is started by the movement of the thrust portion 21 (manual or by means of the opening device) and then executed by the user due to the push/grip by the user on the closure system 7; as in fact described above, the closure system comprises at least a grip portion (10*a* and/or 9*a*) adapted to allow the user to grip the closure system 7 following the extraction of the first coupling portion 12 from the seat 40 of the second coupling portion 13 and move said system 7 from the closed condition to the open condition. Hereinbelow, the method for opening the container 1 is described.

With regard to size, the thrust portion 21 has a predetermined thickness measured along a direction orthogonal to the fold edge 9*a*. The ratio between the thickness of the thrust portion 21 and a depth of the through access 26 is comprised between 0.01 and 0.1.

The first and the second panels 13*a*, 13*b* of the second coupling portion 13 can be integrally joined and essentially obtained via folding of a single sheet. FIG. 6 illustrates an embodiment of the second coupling portion 13 in which the first and second panels 13*a*, 13*b* are folded with respect to each other at a lower fold edge arranged essentially at the base 25; in such configuration, the fold edge between first and second panels 13*a*, 13*b* is defined essentially, during use, below the seat 40: the undercut 16 of the second coupling portion 13 is only delimited by the seat 40 which is configured for receiving and locking the first coupling portion 12 at its own interior.

FIGS. 9A and 9B instead illustrate a second coupling portion 13 in which the first and second panels 13*a*, 13*b* are obtained via folding of a single sheet, at a fold edge 13*d* (upper) which is substantially interposed between the base 25 and the thrust portion 21. In fact, in such configuration the fold edge 13*d* present between first and second panels 13*a*, 13*b* is arranged, during use of the container, above the seat 40. The fold edge 13*d* present between first and second panels 13*a*, 13*b* is configured for essentially defining a further undercut adapted to lock the first coupling portion 12: said fold edge 13*d* is configured for stably locking the first coupling portion 12-optionally the at least one hook 17*a* of the first coupling portion 12-between said first and second panels 13*a*, 13*b*. In fact, in the event in which the first coupling portion 12 is thrust in interposition between the first and second panels, the fold edge present between the latter would allow locking the first coupling portion 12, preventing the same from being disengaged from the second coupling portion 13. Such embodiment therefore allows attaining a second coupling portion 13 that is extremely effective and such to stably lock the first coupling portion 123 even without the presence of glue portions between the first and second panels 13*a*, 13*b* adapted to maintain the latter stably adjacent. Shown in FIG. 9B is the second coupling portion according to a partially frontal view; in such figure, the fold edge 13*d* is visible which integrally joins, on the upper part, the first and second panels 13*a*, 13*b*. The fold edge 13*d* is separate from the at least one hook 16*a* delimited by the seat 40: the fold edge 13*d* is essentially arranged between said at least one hook 16*a* of the second coupling portion 13 and the free edge of the storage 6. The hook 16*a* and the fold edge 13*d* define a series of undercuts adapted to prevent the disengagement of the first coupling portion 12 which is only extractible following a movement of the same (e.g. by means of the thrust portion 21) away from the second panel 13*b*.

Hereinbelow, the second coupling portion 13 is described in accordance with the second embodiment (FIGS. 17-21). The second coupling portion 13 in accordance with the second embodiment can comprise at least one base 25 directly fixed in the internal volume 3, for example by means of gluing, to the front wall 4*a* of the storage 2. The base 25 of the second coupling portion 13 is engaged with the lateral wall 4*a* in proximity to the free edge 6. In particular, the base is hinged to the free edge 6 of the storage, folded within the storage itself and constrained to the front wall 4*a* of the storage, for example by means of gluing. The second coupling portion 13 furthermore comprises at least one undercut 16, carried by the base 25 and defining a central portion of the second coupling portion 13 which nevertheless is not constrained to the front wall 4*a* of the storage. The undercut 16 comprises essentially at least one hook 16*a* only constrained to the front wall 4*a* by means of the base 25 the hook 16*a* and the base 25 are engaged with each other in a single piece without interruption. The base 25 and the hook 16*a* are at least partly divided from each other by means of a notch which allows a relative movement between the base 25 and the hook 16*a*. In particular, the hook 16*a*, in the locking position, has an angular offset with respect to the base 25, different from an angular offset with respect to the same base when the hook 16*a* is in the releasing position. The hook 16*a* and the base 25 also delimit a through opening configured for insertingly receiving at least one part of the first coupling portion 12 to allow the engagement thereof with the second coupling portion 13. The hook 16*a* is arranged within the storage 2, separate and distanced from the free edge 6, and which is configured for being stably engaged, in the closed condition, with the undercut 17 (optionally with the hook 17*a*) of the first coupling portion 12. The through opening defined between hook 16*a* and base 25 is configured for allowing, during the passage from the open condition to the closed condition of the system 7, the passage of the first coupling portion 12 and the insertion of the same below the hook 16*a* of the second coupling portion for the stable engagement of each hook 17*a* of the first coupling portion 12 to the at least one hook 16*a* of the second coupling portion 13. In particular, the hook 16*a* comprises a tongue having a substantially "C" or "U" shape with a concavity that is directed according to a direction entering the storage. The hook 16*a* is movable with respect to the storage 2 at least between:

- the locking position (FIG. 17) in which the hook 16*a* allows the engagement between the undercut 16 and the first coupling portion 12, preventing the disengagement thereof,
- a releasing position (FIG. 19) in which the hook 16*a* allows the first coupling portion 12 to be disengaged from the undercut 16.

It should also be noted that only the hook 16*a* of the second coupling portion 13 is movable at least between the locking position and the releasing position, and vice versa, to allow the movement of the first coupling portion 12 outside the storage 2. Such movement can be executed due to the notch delimiting the base 25 by the hook 16*a*. It is also observed that the hook 16*a*, in the releasing position, has an angular offset, with respect to the base 25, greater than the angular offset of the same hook 16*a*, with respect to the base 25, in the locking position.

Also the second coupling portion 13 in its second embodiment comprises a thrust portion 21 (see for example FIGS. 16 and 18) which is carried by the hook 16*a*: the thrust portion 21 and the hook 16*a* can be integrally joined to define a single tongue made of sheet material. In particular, the thrust portion 21 emerges, for a predetermined extension, directly from the hook 16*a* delimiting the undercut 16 of the second coupling portion 13, optionally on the side opposite the grip edge delimiting the undercut 16.

As with the first embodiment of the second coupling portion 13, the thrust portion 21 carried by the second coupling portion 13 in accordance with the second embodiment is placed at the through access 26: the thrust portion 21 is configured for allowing the movement of at least part of said second coupling portion 13 itself from the locking position to the releasing position. In detail, the thrust portion 21 carried by the second coupling portion 13 in accordance with the second embodiment is configured for allowing the movement of the hook 16*a* of the second coupling portion from the locking position to the releasing position to allow the opening of the container.

The thrust portion 21 is integrally joined to the hook 16*a* and essentially define a single tongue made of sheet material, optionally paper: the thrust portion 21 is integrally movable with the hook 16*a* of the second coupling portion 13 at least between the locking position and the releasing position, and vice versa.

The hook 16*a* of the second coupling portion 13 lies on an extension plane: the thrust portion 21 lies on a respective extension plane substantially parallel to, optionally coinciding with, the extension plane of the hook 16*a*. The thrust portion 21, in the closed condition of the closure system 7, is configured for allowing a user to act, from outside the container, thrustingly on the thrust portion 21 itself in order to move the hook 16*a* (second embodiment of the second coupling portion 13) from the locking position to the releasing position in order to execute the disengagement between the first and the second coupling portions 12, 13. In fact, the through access 26 is configured to allow the access to the internal volume 3 of the storage 2, as well as in order to allow a user to act on the thrust portion 21 in order to allow the disengagement of the first and second coupling portions 12, 13 and hence the passage of the closure system 7 from the closed condition to the open condition. In other words, the through access 26 is therefore configured for allowing a user, from outside the container, to execute the movement of the hook 16*a* from the locking position to the releasing position due to the thrust portion which acts, as will be better described hereinbelow, as an element useful for the direct movement by the hook 16*a* or as an element for guiding the opening device 19.

The thrust portion 21 is carried directly by the hook 16*a* of the second coupling portion 13 (second embodiment), which at least during the closed condition of the closure system 7 can:

- at least partly traverse said through access 26, optionally at least partly exit outward from the container (see for example FIG. 16). In such configuration, the thrust portion 21, in the closed condition of the closure system 7, at least partly traverses a through access 26, emerging from the internal volume 3 of the storage 2; or
- face said through access 26, without traversing it.

The thrust portion 21 is then configured for allowing the rotation of the hook 16*a* from the locking position to the releasing position. In fact, the thrust portion 21 carried by the second coupling portion 13 in accordance with the second embodiment can be of the type described above associated with the second coupling portion 13 in accordance with the first embodiment; unlike that described above, the thrust portion is, in this case, carried directly by the hook 16*a* and allows the movement of the latter in order to allow the disengagement between the same hook 16*a* of the second coupling portion 13 and the at least one hook 17*a* of the first coupling portion 12.

As described above, the first and the second coupling portions 12, 13 are configured for being reversibly engaged with each other, i.e. configured for being newly engaged with each other following a condition of disengagement.

Both the first and the second coupling portion 12, 13 are totally lacking weakening portions (e.g. notches and/or thickness reductions) configured to allow the facilitated breakage of the latter.

The container 1 can nevertheless have at least one removable tongue 15 (see for example FIG. 10) engaged with the closure system 7. The removable tongue 15 is placed to at least partially close the through access 26 and is configured to be completely separated from the closure system 7 following an intervention attempt by the user on the thrust portion 21. In detail, the removable tongue 15 is configured to be separated from the closure system 7, in the locking condition, following an intervention attempt, manual and/or by means of the opening device 19, by the user on the thrust portion 21. In this manner, the absence of the removable tongue 15 can indicate to the user that there has been a first attempt to open/tamper with the container The removable tongue 15 is placed within the through access 26; the removable tongue 15 is integrally joined to the closure system 7 by means of at least one weakened portion, for example comprising attachment points that are easily breakable following an attempt to move the thrust portion 21. The weakened portion is joined to the removable tongue 15 and is configured for being broken following an intervention, optionally manual and/or by means of an opening device, on the removable portion itself 15. The removable tongue 15 can totally obstruct the through access 26 (FIG. 9B) or, as is for example illustrated in FIG. 10, it can only obstruct a part of the through access 26; it is in fact sufficient that the tongue 15 is opposed to the movement of the thrust portion 21 and/or that it prevents the user from reaching the thrust portion 21.

In other words, the removable tongue 15 allows at least partly obstructing the through access 26 and/or limits the movement of the thrust portion 21; therefore, any one attempt to open the container by means of traversing the through access 26 and/or by means of the movement of the thrust portion 21 would cause, due to the structure of the tongue 15, the breakage of the latter and the consequent indication for the user that there has been a tampering attempt of the container.

As described above, the disengagement between the first and the second coupling portions 12, 13 can be executed by means of an opening device 19 which can, in a non-limiting manner, be part of the container 1. The opening device 19 can be made of paper sheet material; nevertheless, the opening device 19 can be made of further materials, such as plastic sheet material or metallic sheet material. For such purpose, the opening device 19 can be obtained by means of folding two superimposed layers made of sheet material, having a rigidity substantially equal to or greater than a rigidity of the first and of the second coupling portion 12, 13. In detail, the opening device 19 can have a shape substantially as a "T" comprising an unlocking portion 19*b*, configured for being at least partially inserted within the through access 26 and a grip portion 19*a* configured for being gripped by a user in order to move the opening device within the storage. The unlocking portion 19*b*, during the dosed condition, is guided by the thrust portion 21 in interposition between the first and the second coupling portions 12, 13, allowing the lifting and the extraction of the same first coupling portion 12. The opening device 19 can be obtained from the same sheet blank through which the container is attained. For example, the opening device can be obtained by means of a sheet portion of the storage 2. The container also comprises a pocket associated with at least one from between the storage 2 and the closure system 7, configured for at least partly housing the opening device 19 when the latter is not arranged in insertion in the internal volume 3 of the storage 2. In particular, the pocket is defined on the storage 2, entirely arranged in the internal volume 3. The container furthermore comprises a slit arranged on the storage 2 and configured for allowing a user, from outside the container, to reach the pocket in order to pick up or deposit the opening device 19. By means of the slit and from outside the container, a user can grasp the grip portion 19*a* of the opening device 19 in order to pick up or deposit the latter in the pocket.

Blank

The present invention also relates to a blank 50 made of paper sheet material, starting from which it is possible to attain the container 1.

Figure 8:
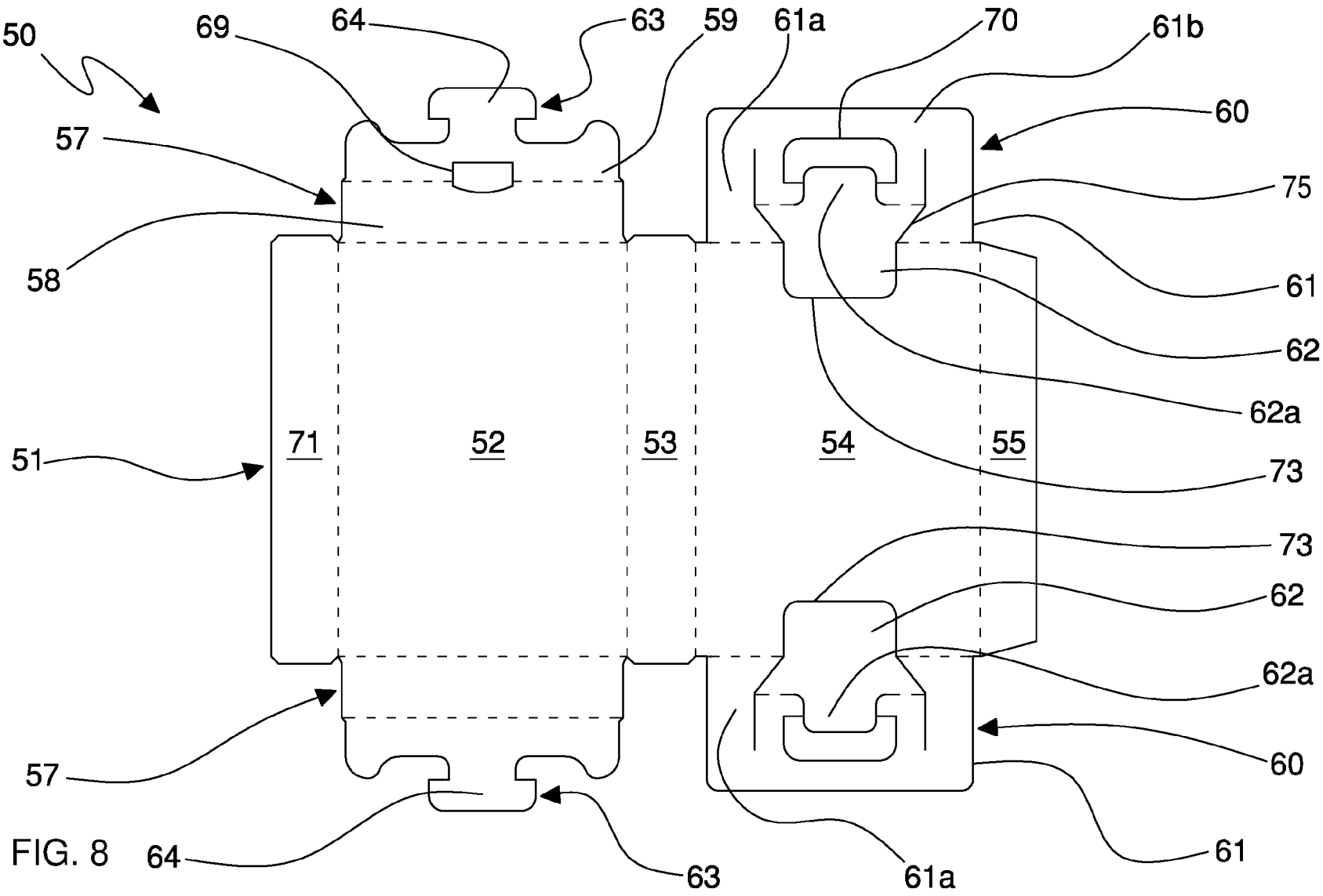
FIG. 8 shows an embodiment variant of a blank for making a container in accordance with the first embodiment.
Figure 11:
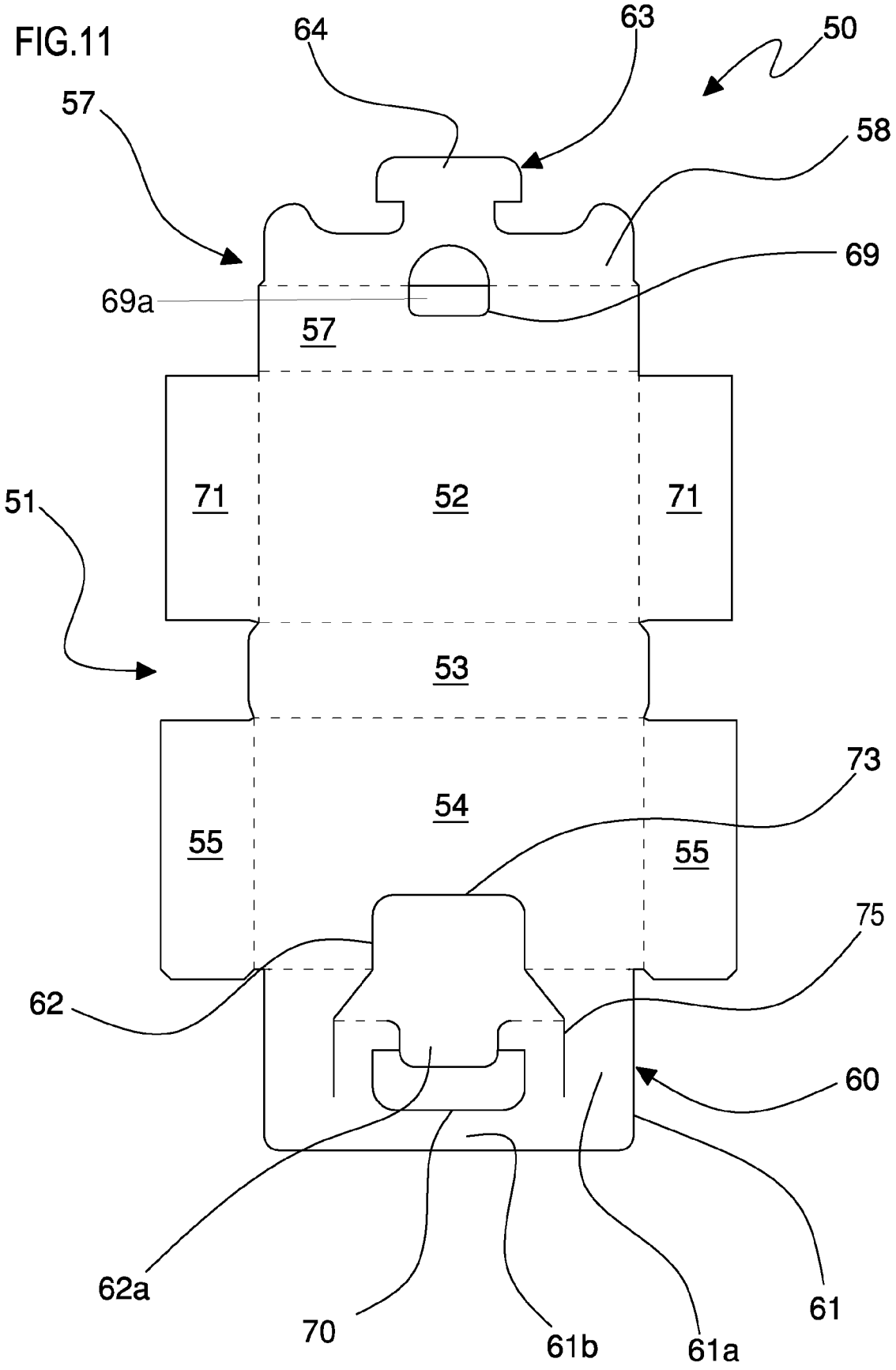
FIGS. 11 and 12 show respective blanks for making the container of FIG. 10.

FIGS. 1, 8 and 11 illustrate a blank 50 starting from which it is possible to make, via folding, the container in accordance with the first embodiment. The blank 50 illustrated in FIGS. 7, 8 and 11 comprises at least one first sheet 51 comprising at least one first and one second portion 52, 54 interconnected by a central connection portion 53. The first sheet 51 also comprises at least one first lateral connection portion 55 interconnected to the second portion 54. As is visible for example in FIG. 1, the central connection portion 53 is interposed between the first and the second portion 52, 54, while the second portion 54 is interposed between the first lateral connection portion 55 and the central connection portion 53. Each of said portions 52, 53, 54, 55 comprises at least two opposite longitudinal edges and two opposite end edges: the portions 52, 54, the central connection portion 53 and optionally the first lateral connection portion 55 are joined along the longitudinal edges and aligned along a single connection direction. In the blank of FIG. 11, the first lateral connection portion 55 is placed transverse to the second portion 54 of the first sheet 51. The first portion 52 of the first sheet 51 has a rectangular shape delimited perimetrically by a lower edge, a first and second lateral edge and an upper edge. Analogously, the second portion 54 of the first sheet 51 has a rectangular shape delimited perimetrically by a lower edge, a first and second lateral edge and an upper edge. The first and the second portion 52, 54 can comprise a sheet having substantially the same shape and size. The central portion 53 and the first lateral connection portion 55 can substantially have the same shape and the same size and they are integrally joined to the portions 52 and 54 of the first sheet 51.

The first sheet 51 can also comprise a second lateral connection portion 71 which can be directly interconnected to the first lateral connection portion 55 (FIG. 1) or it can be directly carried by the first portion 52 of the first sheet (see for example FIGS. 8 and 11). As is visible in FIG. 1, the second lateral connection portion 71 can have the same dimensions of the first lateral connection portion 55; nevertheless it may be that the second lateral connection portion 71 has dimensions different from the latter. In particular, the end portion 71 can have dimensions smaller than the first lateral connection portion 55.

The blank 50 can also comprise a second sheet 57 integrally joined to the first sheet 51 at at least one end edge of the first portion 52 of the first sheet 51. The second sheet 57 comprises at least one first and one second portion 58, 59 integrally joined to each other: the first portion 58 of the second sheet 57 is connected to the first sheet 51 in a manner such that said first portion 58 is interposed between the second portion 59 of the second sheet 57 and the first sheet 51. In the enclosed figures, embodiments of the invention are illustrated by way of example in which the arrangement is provided with two second sheets 57 engaged with the first sheet 51 respectively at the lower edge and at the upper edge and arranged opposite with respect to the first sheet 51. The second sheets 57 can be respectively directly connected to the upper edge and to the lower edge of the first portion 52 of the first sheet 51. The first and the second portions 58, 59 of the second sheet 57 are intended to respectively form the closure portion 9 and the inserting portion 10 of the closure system 7 of the container 1 that is described above.

The blank 50 also comprises at least one third sheet 60 integrally joined to the first sheet 51 at an end edge of the second portion 54 of the first sheet. The third sheet 60 is intended to form the second coupling portion 13 of the container 1. The third sheet 60 comprises a first portion 61 and a second portion 62 which are respectively configured to define the first and the second panels 13*a*, 13*b* of the second coupling portion 13. As is visible, the first portion 61 of the third sheet is interposed between the second portion 62 of the third sheet and the second portion 54 of the first sheet 51.

The first portion 61 of the third sheet 60 comprises a first notch 70 configured for defining a through groove adapted to define-following the folding of the third sheet 60—the through opening of the first panel 13*a*; the first notch 70 also allows defining the undercut 16 of the second coupling portion 13.

The first portion 61 of the third sheet 60 comprises at least one second notch 75 configured for defining on the first portion 61 of the third sheet: at least one lateral shoulder 61*a*, at least one central body 61*b* integrally joined with said shoulder and movable with respect to the latter due to the presence of said second notch 75. The third sheet 60 comprises a third portion 62*a* emerging from the second portion 62 and configured for defining the thrust portion 21; the second portion 62 of the third sheet 60 is interposed between the first and the third portion of the third sheet 60. In the blank of FIG. 1, the first notch 70 only delimits the undercut 16 of the first panel 13*a* while the second notch 75 only delimits the central body 61*a* and the lateral shoulder 61*b*. In the blank of FIGS. 8 and 11, the first notch 70 delimits the undercut 16 of the first panel 13*a* and at least one part of the third portion 62*a*; still in the blank of FIGS. 8 and 11, the second notch 75 delimits the central body 61*a* and the lateral shoulder 61*b* and also delimits at least one part of the second portion 62 of the third sheet 63 which is placed at least partly within a cavity delimited by the lateral shoulder 61*b*. The blank 50 of FIGS. 1, 8 and 11 also comprises a further notch 73 executed at opposite end edges of the same second portion 54, and adapted to define the depression 23. In fact, the further notch 73 and the second notch are joined together and are extended without interruption to essentially define a single notch which is partly extended on the third sheet 60 and partly extended on the first sheet 51.

The blank 50 also comprises at least one fourth sheet 63 integrally joined to the second sheet 57 at an end edge of the second portion 59 of the second sheet 57. The fourth sheet 63 comprises at least one portion 64 intended to form the first coupling portion 12. The blank 50 can comprise two fourth sheets 63 (FIG. 1) engaged with respective second sheets 57 and arranged opposite with respect to the first sheet 51. The fourth sheet 63 is configured for forming the first coupling portion 12 of the container 1 that is described above. The portion 64 of the fourth sheet 63 can be shaped as a hook, in a manner such to form the hook of the first coupling portion 12.

The blank 50 can also comprise at least one notch 69 defined on the first portion 58 of the second sheet 57: the notch 69 has a shape substantially as a rectangle with dosed profile defining the through access 26. The notch 69 can be attained in a manner such that within the notch itself a tongue 69*a* can remain that is configured for defining the removable tongue 15. Furthermore the blank 50 can comprise at least one notch 74 defined in interposition between the first portion 52 and the central connection portion 53, in a manner such to define the pocket adapted to receive the opening device 19.

FIGS. 1 and 8 show a blank 50 in which two third sheets 60 emerge laterally from the first sheet 51 starting from the second portion 54, one opposite the other: two fourth sheets are also present, respectively emerging from two second sheets 57 that are opposite each other. Such blanks are configured for making a container in accordance with the first embodiment in which the storage 2 has two opposite passage openings 5: consequently the container 1 comprises two closure systems 7 and respective first and second coupling portions 12, 13.

Figure 12:
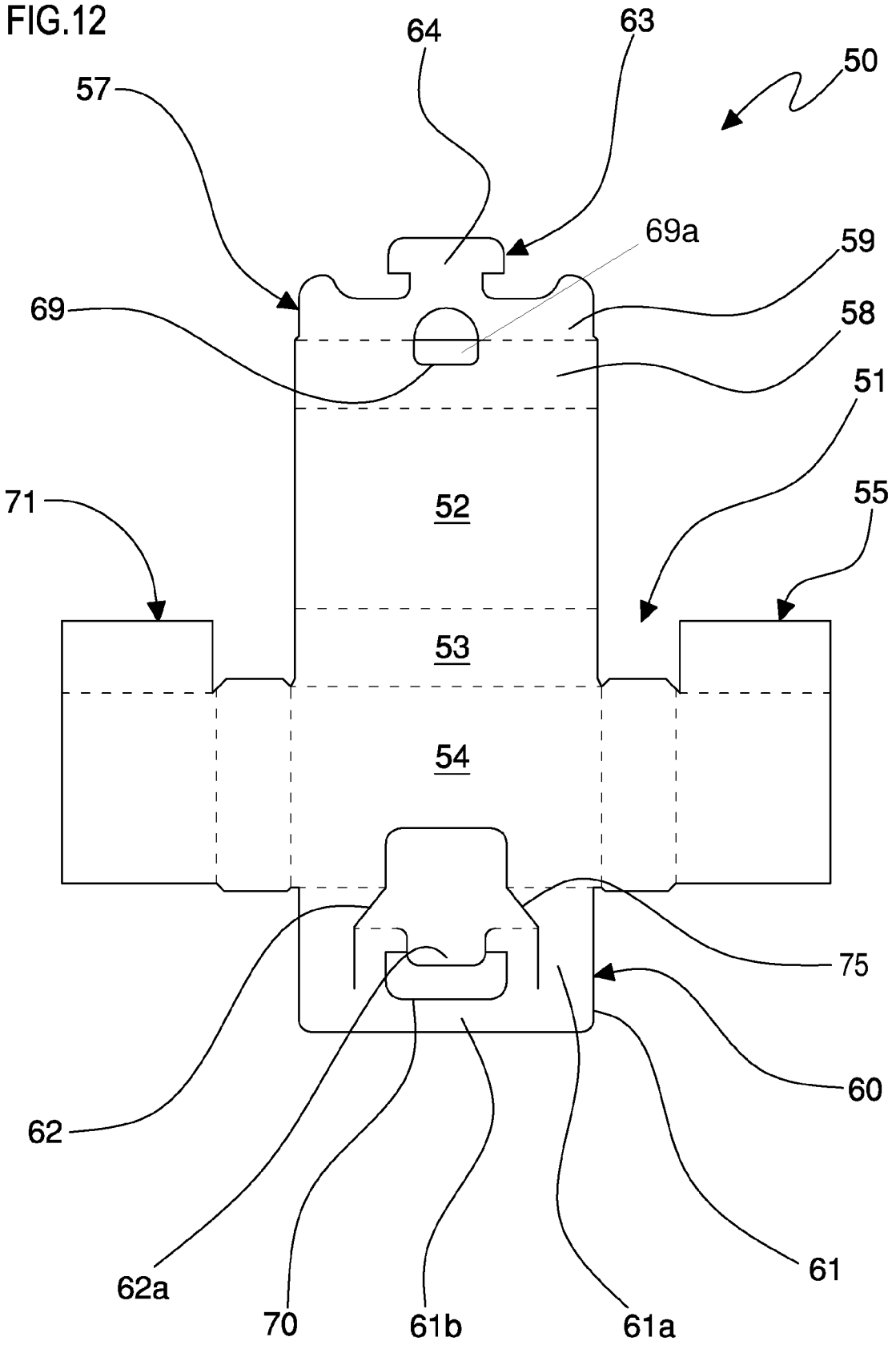

FIGS. 11 and 12 illustrate an embodiment variant of the blank 50 that has only one third sheet 60 and only one fourth sheet 63 and the portions of the first sheet are oriented in a manner such to define a storage 5 having a single passage opening 5.

Figure 15:
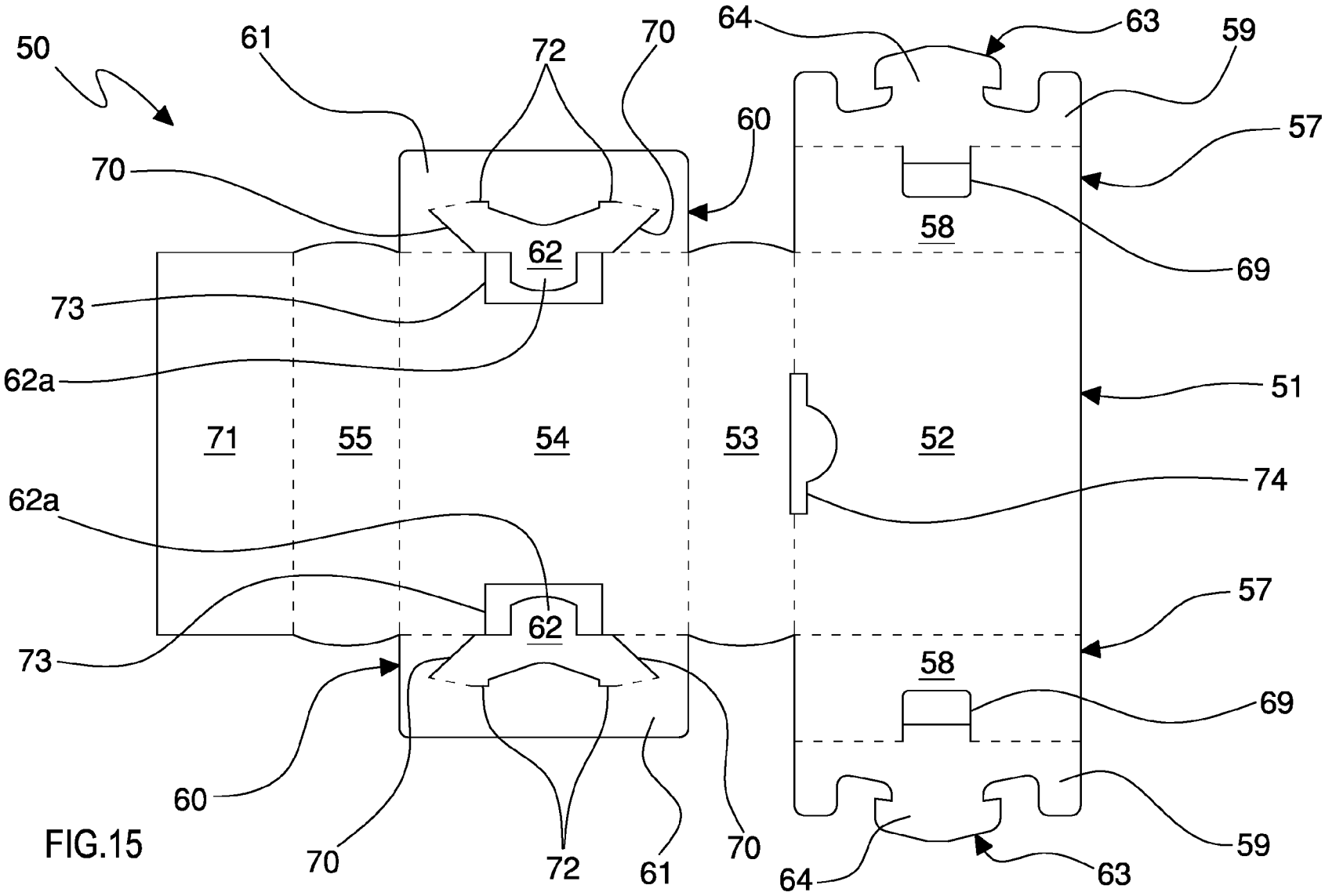
FIG. 15 shows a blank for making a container in accordance with a second embodiment.

FIG. 15 illustrates a blank 50 starting from which it is possible to attain, via folding, the container in accordance with the second embodiment. Such blank 50 comprises the first and second sheets in accordance with the above-described blank. Furthermore, the blank 50 of FIG. 15 comprises at least one third sheet 60 integrally joined to the first sheet 51 at an end edge of the second portion 54 of the first sheet. The third sheet 60 is intended to form the second coupling portion 13 of the container 1 that is previously described.

The third sheet 60 comprises a first portion 61, a second portion 62 and a third portion 62*a*; the first portion 61 is intended to constitute the base 25 of the second coupling portion 13, the second portion 62 is intended to constitute the main body 27 of the second coupling portion 13, while the third portion 62*a* is intended to define the thrust portion 21. In particular, the first portion 61 has at least one first notch 70 configured for:

- dividing the base 25 with the main body 27 and the thrust portion 21,
- defining the undercut 16 and the hook 16*a* of the second coupling portion 13.

The second portion 54 of the first sheet 51 comprises at least one notch 73, executed at opposite end edges of the same second portion 54, and adapted to define the depression 23.

In the enclosed figures, embodiments of the invention are illustrated in which the blank 50 comprises two third sheets 60 engaged with the first sheet 51 and arranged opposite with respect to the latter. The third sheets 60 can be respectively directly connected to the end edges of the second portion 54 of the first sheet 51.

The blank 50 also comprises at least one fourth sheet 63 integrally joined to the second sheet 57 at an end edge of the second portion 59 of the second sheet 57. The fourth sheet 63 comprises at least one portion 64 intended to form the first coupling portion 12. FIG. 15 shows, as a non-limiting example, the blank 50 comprising two fourth sheets 63 engaged with respective second sheets 57 and arranged opposite with respect to the first sheet 51. The fourth sheet 63 is configured for forming the first coupling portion 12 of the container 1 that is described above. The portion 64 of the fourth sheet 63 can be shaped as a hook, in a manner such to form the hook of the first coupling portion 12.

The blank 50 can also comprise at least one notch 69 defined on the first portion 58 of the second sheet 57: the notch 69 has a shape substantially as a rectangle with closed profile defining the through access 26. The notch 69 can be attained in a manner such that within the notch itself, a tongue 69*a* can remain that is configured for defining the removable tongue 15. Furthermore the blank 50 can comprise at least one notch 74 defined in interposition between the first portion 52 and the central connection portion 53, in a manner such to define the pocket adapted to receive the opening device 19.

Process for Making the Container

Also forming the object of the present invention is a process for making the container 1 according to the enclosed claims and/or with the above-reported description. The container 1 is attained starting from a single sheet blank 50 made of paper material of the above-described type obtained by means of one or more steps of die cutting of a single flat precursor sheet made of paper material. As will be seen in detail hereinbelow, the process provides for folding the blank 50 and the connection of several portions thereof, for example by means of gluing, to form the container 1. The process can comprise a step of engaging a film made of plastic material on at least part of the first main extension surface of the sheet blank 50 and, in addition or as an alternative, on the second main extension surface of the sheet blank 50.

The process provides for a step of providing the storage 2. Such step provides for folding the portions 52, 53, 54, 55, 71 and the joining of such portions (e.g. the second lateral connection portion 71 with the first portion 52), for example by means of gluing, to form the storage 2 defining substantially a duct or a tube laterally delimited by the walls 4*a*, 4*b*, 4*c*, 4*d* and open at opposite longitudinal ends. The walls 4*a*, 4*b*, 4*c*, 4*d* are respectively defined by the first portion 52, by the second portion 54, by the central connection portion 53 and by the first lateral connection portion 55. The storage can also be attained by means of joining the first and the second lateral connection portion 55, 71 of the blank of FIG. 8. Alternatively, the storage 2 can be closed without providing for the step of fixing the walls by means of glue; for example, the blank 50 of FIG. 11 has a structure which allows the same, following the folding thereof, to remain in a three-dimensional configuration.

It should be noted that the step of providing the first sheet 51 can provide for a step of die cutting, which allows defining, on the same sheet, fold lines coinciding with the longitudinal lateral edges of the portions of the first sheet 51. In fact, the steps of folding the portions 52, 53, 54, 55 of the first sheet 51 occurs along the longitudinal lateral edges of the portions 52, 53, 54, 55, 71 which are crushed so as to facilitate the movement by folding.

The process also provides for the arrangement of the closure system 7. The arrangement of the closure system 7 provides for folding the second portion 59 of the second sheet 57 with respect to the first portion 58 of the second sheet 57 and folding the first portion 58 of the second sheet 57 with respect to the first portion 52 of the first sheet 51 in a manner such to form the closure portion 9 and the inserting portion 10 of the closure system 7 that is described above. In order to make the second coupling portion 13, different steps can be provided as a function of the blank employed. By using the blank in accordance with FIGS. 1, 8 and 11, the second coupling portion 13 is defined by means folding the second portion 62 above the first portion 61 and fixing the latter by means of glue; in particular only a part of the second portion 62 of the third sheet 60 is glued to the central body 61*a* of the third sheet; then, the first and the second portion of the third sheet are folded above the second portion 54 of the first sheet and the at least one lateral shoulder 61*b* is fixed, for example by means of glue, to said second portion 54. The central body 61*a* of the first portion of the third sheet 60 is not directly constrained to the first sheet 51 in a manner such that the second coupling portion 13 can be movable with respect to the storage 2 between the locking position and the releasing position, and vice versa. In fact, only following the superimposition of the second portion 62 of the third sheet above the first portion 61 of the same third sheet 60, one obtains the definition of the seat 40 of the second coupling portion. In fact, the through pocket defined by the first notch 70 executed on the first portion 61 is laterally closed (made blind) by the second portion 62 in a manner such that the first portion can define the first panel 13*a* on which the undercut 16 is defined while the second portion cooperates with the first portion in order to define the seat 40.

By using the blank in accordance with FIG. 15, the second coupling portion 13 is defined by means of folding the first, second and third portion above the second portion 54 of the first sheet and the direct constraint of a part of the second portion 62 of the third sheet 62 to said second portion 54 of the first sheet: the first portion 61 of the third sheet is not constrained in a manner such that the latter can define the movable hook 16*a* with respect to the storage 2.

Following the folding of the first and second portions 61, 62 of the third sheet, one simultaneously obtains the definition of the thrust portion 21 defined by the third portion 62*a* of the third sheet. The first coupling portion 12 is instead defined by the portion 64 of the fourth sheet 63 which emerges, without interruption, from the second portion 59 of the second sheet. First, second, third and fourth sheets are integrally joined to define a single blank in a single piece, obtainable by means of a single step of die cutting. The attainment of the container can be executed on a folding-gluing machine.

Method for Opening the Container

The present invention also relates to a method for opening the container 1. The method for opening the container 1 provides for providing a container 1 according to any one of the previously described embodiments. The previously arranged container 1 has the closure system 7 in closed condition.

The method for opening the container 1 provides for the movement of the thrust portion 21 by means of a manual action of the user or by means of the engagement of the opening device 19 to move at least part of the second coupling portion 13 from the locking position to the releasing position. Such action can be completely carried out outside of the container 1 by means of a manual action of the user or it can be executed by means of the insertion of a user's finger or of the opening device 19 through the through access 26 in order to cause the activation of the thrust portion 21 and the consequent movement of the second coupling portion 13.

For example, such method can provide for the at least partial insertion of a user's finger through the through access 26 in order to contact the grip portion 21 and move it along the depth of the through access 26, in a manner such to allow the movement of the main body 27 with respect to the lateral wall 4*a* in order to disengage the first and the second coupling portions 12, 13. Such step also allows the user to reach the grip portions 9*a* and/or 10*a* which allow the same to extract the first coupling portion 12 outside the storage and, consequently, the passage of the closure system 7 from the closed condition to the open condition Following the disengagement of the first coupling portion 12 from the second coupling portion 13, the method provides for moving the closure system 7 via rotation around the free edge 6 of the storage 2, determining the opening of the container 1. It is also observed that the opening of the container can further occur following the gripping, with a hand, of the container from the rear portion 4*b* of the storage. With the same hand, it is then possible to reach and move the thrust portion 21 from the locking position to the releasing position without inserting a finger within the through access 26. The opening of the container occurs following the reaching, by means of the same hand or with the other hand, of the grip portion 9*a* and/or 10*a* and of the movement of the closure system 7 via rotation around the free edge 6 of the storage 2.

The method for opening the container 1 can furthermore provide for at least partially inserting an opening device 19 in the internal volume 3 of the storage 2 through the through access 26. The opening device 19 enters into the internal volume 3 of the storage 2 and contacts the first and the second coupling portions 12, 13, determining the at least partial rotation of the main body 27 from the locking position to the releasing position, allowing the opening device 19 to disengage the first coupling portion 12. The disengagement of the first coupling portion 12 then allows the extraction of the first coupling portion 12 from the second coupling portion 13 and consequently the passage of the closure system 7 from the closed condition to the open condition.

For example, in the first embodiment of the container illustrated in FIGS. 2 and 3 the user can insert a finger through the through access 26 (FIG. 3) to move the thrust portion 21 and consequently grasp with the same hand the grip portion 10*a* of the inserting portion for the extraction of the first coupling portion 12 from the seat 40. Similarly, the user can insert an opening device 19 through the through access 26 in a manner such to insert said device 19 in the seat 40 and cause the disengagement of the coupling portions 12 and 13 and simultaneously grasp, with the same hand, the grip portion 10*a* of the inserting portion to allow the movement of the closure system 7 from the closed condition to the open condition. FIGS. 9-10 instead illustrate a container 1 having a thrust portion 21 placed within the storage 2. The configuration of the container illustrated in FIGS. 9-10 allows the user to grasp the container with a hand and with the same hand insert a finger through the through access 26 to move the thrust portion and consequently the second coupling portion 13 from the locking position to the releasing position; with the same finger placed within the storage 2, the user can push on the grip portion 9*b* defined on the closure portion 9 to allow the movement of the closure system 7 from the closed condition to the unlocked position. In fact, with a single hand, the user can firmly grasp the container, disengage the first and the second coupling portions 12, 13 and then move the closure system from the closed condition to the open condition.

In the configuration of FIG. 13, the user can move the thrust portion 21 (portion emerging from the through access 26) and simultaneously grasp the grip portion 10*a* of the inserting portion 10 emerging from the free edge 6 of the storage; then, the user can thus extract the first coupling portion 12 from the seat 40 and move the system 7 from the closed condition to the open condition.

Also for the second embodiment of the container illustrated in FIGS. 16-21 the user can move the hook 16*a* through the thrust portion, for example by inserting a finger through the through access 26, and simultaneously grasp with the same hand the grip portion 10*a* of the inserting portion (see for example FIG. 18) for the disengagement of the hook 17*a* of the first coupling portion 12 from the hook 16*a* of the second coupling portion 13. Similarly, the user can insert an opening device 19 through the through access 26 in a manner such to insert said device 19 in interposition between the coupling portions 12 and 13 and simultaneously grasp, with the same hand, the grip portion 10*a* of the inserting portion to allow the movement of the closure system 7 from the closed condition to the open condition.

The invention claimed is:

1. A child-proof container comprising:

a storage defining an internal volume configured to house a product, the storage having a predetermined number of lateral walls defining a passage opening delimited by a free edge, said passage opening configured to place the internal volume in communication with an external environment, a closure system, movable with respect to the storage at least between:

a closed condition in which the closure system prevents the communication between the internal volume of the storage and the external environment, and an open condition in which the closure system allows the communication between the internal volume and the external environment, a first coupling portion carried by the closure system, and a second coupling portion carried by the storage and arranged at least partly in the internal volume, wherein the first and the second coupling portions, while in the closed condition, are configured to be engaged with each other to define a locking condition of the container in which said first and second coupling portions prevent the closure system from passing from the closed condition to the open condition, wherein the second coupling portion defines undercut configured for engaging, in the closed condition of the container, the first coupling portion to define said locking condition, wherein the second coupling portion comprises:

a first panel engaged with the storage, said first panel comprising a through opening configured for defining said undercut, and a second panel engaged with the first panel, wherein the second panel is arranged at the through opening of the first panel to define, in cooperation with said through opening of the first panel, a seat configured for housing, during the closed condition of the closure system, the first coupling portion to allow the engagement between said first and second coupling portions, wherein the second panel overlaps the first panel and closes the through opening of the first panel.

2. The child-proof container according to claim 1, wherein the first and the second panels are engaged with each other to define a folded portion, and wherein said folded portion is substantially parallel to a lateral wall of the storage directly carrying said second coupling portion.

3. The child-proof container according to claim 1, wherein the second panel is directly engaged with while overlapping the first panel, and wherein the second panel is only engaged with the first panel.

4. The child-proof container according to claim 1, wherein the second coupling portion is at least partly movable with respect to the storage at least between:

a locking position in which the second coupling portion allows the engagement between the undercut and the first coupling portion, and a releasing position in which the second coupling portion is configured to allow the first coupling portion to disengage from the undercut allowing the passage of the closure system from the closed condition to the open condition.

5. The child-proof container according to claim 4, wherein the closure system comprises a through access, wherein the container comprises a thrust portion carried by the second coupling portion and placed at the through access, said thrust portion is configured to allow the movement of at least part of said second coupling portion from the locking position to the releasing position.

6. The child-proof container according to claim 5, wherein the closure system comprises a closure portion engaged with the free edge of the storage and movable with respect to the storage, wherein the closure system includes an inserting portion engaged with the closure portion on the side opposite the free edge of the storage, wherein the inserting portion configured to be inserted, in the closed condition of the closure system, in the internal volume of the storage, wherein the through access is defined on the closure portion or on the inserting portion, and wherein the through access is configured to allow a user, in the locking condition and from outside the container, to manually intervene or by means of an opening device on the thrust portion to allow the movement of at least part of the second coupling portion from the locking position to the releasing position.

7. The child-proof container according to claim 6, wherein the thrust portion is integrally joined to the second panel of the second coupling portion, and wherein said thrust portion emerges from the second panel.

8. The child-proof container according to claim 7, wherein the through access is configured to allow a user, from outside the container, to manually contact said thrust portion to move said first and second panels from the locking position to the releasing position.

9. The child-proof container according to claim 7, wherein the thrust portion, at least in the locking condition, is configured to guide the insertion of an opening device within the seat between the second panel and a lateral wall of the predetermined number of lateral walls of the storage directly carrying said first panel to allow the first and the second coupling portions to disengage.

10. The child-proof container according to claim 5, wherein the thrust portion, at least in the locking condition of the container: at least partly crosses said through access or faces the through access and is entirely housed in the internal volume of the storage.

11. The child-proof container according to claim 1, wherein at least part of the first panel and at least part of the second panel are movable with respect to the storage to define:

the locking position of the second coupling portion in which said first and second panels are approached to a lateral wall of the storage with which the first panel is engaged and configured for allowing the locking of the first coupling portion within the seat, and the releasing position of the second coupling portion in which said first and second panels are at least partly distanced from the lateral wall of the storage with which the first panel is engaged to allow the first coupling portion to disengage.

12. The child-proof container according to claim 11, wherein the first panel comprises:

a base directly glued to the storage, and a main body carried by the base and on which said at least the undercut of the second coupling portion is defined, wherein the second panel is directly constrained only to the main body of the first panel, wherein only the main body of the first panel and the second panel are movable at least between the locking position and the releasing position.

13. The child-proof container according to claim 1, wherein the undercut defined by the through opening of the first panel defines a first hook configured to engage, at least in the locking condition, a second hook defined by the first coupling portion, wherein the second hook is completely arranged in the internal volume of the storage.

14. A child-proof container comprising:

a storage defining an internal volume configured to house a product, the storage including a predetermined number of lateral walls defining a passage opening delimited by a free edge, said passage opening configured to place the internal volume in communication with an external environment, a closure system is movable with respect to the storage at least between:

a closed condition in which the closure system that prevents the communication between the internal volume of the storage and the external environment, and an open condition in which the closure system allows the communication between the internal volume and the external environment, a first coupling portion carried by the closure system, a second coupling portion carried by the storage and arranged at least partly in the internal volume, wherein the first and the second coupling portions, in the closed condition, are configured to engage each other to define a locking condition of the container in which said first and second coupling portions prevent the closure system from passing from the closed condition to the open condition, wherein the second coupling portion defines an undercut configured for engaging, in the closed condition of the container, the first coupling portion to define said locking condition, wherein the second coupling portion is at least partly movable with respect to the storage at least between:

a locking position in which the second coupling portion allows the engagement between the undercut and the first coupling portion, and a releasing position in which the second coupling portion allows the first coupling portion to be disengaged from the undercut to allow the passage of the closure system from the closed condition to the open condition, wherein the closure system comprises a through access, wherein the container also comprises a thrust portion carried by the second coupling portion and placed at the through access, said thrust portion being configured to allow the movement of at least part of said second coupling portion from the locking position to the releasing position, and wherein the through access is configured to allow a user, in the locking condition and from outside the container, to manually intervene or by means of an opening device on the thrust portion to allow the movement of at least part of the second coupling portion from the locking position to the releasing position.

15. The child-proof container according to claim 14, wherein the closure system comprises a closure portion engaged with the free edge of the storage and movable with respect to the storage, wherein the closure system includes an inserting portion engaged with the closure portion on the side opposite the free edge of the storage, said inserting portion is configured to be inserted, in the closed condition of the closure system, in the internal volume of the storage, wherein the through access is defined on the closure portion or on the inserting portion and configured to allow a user, in the locking condition and from outside the container, to manually intervene or by means of an opening device on the thrust portion to allow the movement of at least part of the second coupling portion from the locking position to the releasing position.

16. The child-proof container according to claim 14, wherein the thrust portion, at least in the locking condition of the container:

at least partly crosses said through access, or faces the through access and is entirely housed in the internal volume of the storage.

17. The child-proof container according to claim 14, wherein the through access is configured to allow a user, from outside the container, to manually contact said thrust portion to move the second coupling portion from the locking position to the releasing position.

18. A child-proof container comprising:

a storage defining an internal volume configured to house a product, the storage including a predetermined number of lateral walls defining a passage opening delimited by a free edge, said passage opening configured to place the internal volume in communication with an external environment, a closure system is movable with respect to the storage at least between:

a closed condition in which the closure system that prevents the communication between the internal volume of the storage and the external environment, and an open condition in which the closure system allows the communication between the internal volume and the external environment, a first coupling portion carried by the closure system, a second coupling portion carried by the storage and arranged at least partly in the internal volume, wherein the first and the second coupling portions, in the closed condition, are configured to engage each other to define a locking condition of the container in which said first and second coupling portions prevent the closure system from passing from the closed condition to the open condition, wherein the second coupling portion defines an undercut configured for engaging, in the closed condition of the container, the first coupling portion to define said locking condition, wherein the second coupling portion is at least partly movable with respect to the storage at least between:

a locking position in which the second coupling portion allows the engagement between the undercut and the first coupling portion, and a releasing position in which the second coupling portion allows the first coupling portion to be disengaged from the undercut to allow the passage of the closure system from the closed condition to the open condition, wherein the closure system comprises a through access, wherein the container also comprises a thrust portion carried by the second coupling portion and placed at the through access, said thrust portion being configured to allow the movement of at least part of said second coupling portion from the locking position to the releasing position, and wherein the thrust portion, at least in the locking condition of the container:

at least partly crosses said through access, or faces the through access and is entirely housed in the internal volume of the storage.

* * * * *